US009383663B2

(12) United States Patent
Ito et al.

(10) Patent No.: US 9,383,663 B2
(45) Date of Patent: Jul. 5, 2016

(54) ELECTROPHOTOGRAPHIC PHOTOSENSITIVE MEMBER, METHOD OF PRODUCING ELECTROPHOTOGRAPHIC PHOTOSENSITIVE MEMBER, PROCESS CARTRIDGE, AND ELECTROPHOTOGRAPHIC APPARATUS

(71) Applicant: CANON KABUSHIKI KAISHA, Tokyo (JP)

(72) Inventors: Yota Ito, Mishima (JP); Michiyo Sekiya, Atami (JP); Kunihiko Sekido, Suntou-gun (JP); Atsushi Okuda, Yokohama (JP); Nobuhiro Nakamura, Mishima (JP); Kazunori Noguchi, Suntou-gun (JP); Daisuke Tanaka, Yokohama (JP); Kazumichi Sugiyama, Numazu (JP); Yuka Ishiduka, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/091,139

(22) Filed: Nov. 26, 2013

(65) Prior Publication Data

US 2014/0154620 A1 Jun. 5, 2014

(30) Foreign Application Priority Data

Nov. 30, 2012 (JP) ..... 2012-263255
Feb. 19, 2013 (JP) ..... 2013-030118
Jul. 23, 2013 (JP) ..... 2013-152791

(51) Int. Cl.
*G03G 5/14* (2006.01)
*G03G 5/047* (2006.01)
*G03G 5/06* (2006.01)

(52) U.S. Cl.
CPC ..... *G03G 5/047* (2013.01); *G03G 5/065* (2013.01); *G03G 5/0609* (2013.01); *G03G 5/0612* (2013.01); *G03G 5/0651* (2013.01); *G03G 5/0657* (2013.01); *G03G 5/142* (2013.01); *G03G 5/144* (2013.01)

(58) Field of Classification Search
CPC ..... G03G 5/14; G03G 5/142; G03G 5/144
See application file for complete search history.

(56) References Cited

U.S. PATENT DOCUMENTS 4,442,193 A 4/1984 Chen
4,562,132 A 12/1985 Ong
(Continued)

FOREIGN PATENT DOCUMENTS

CN 1325039 A 12/2001
JP 01206349 A 8/1989
(Continued)

OTHER PUBLICATIONS

Translation of JP 09-197701 published Jul. 1997.*
(Continued)

*Primary Examiner* — Peter Vajda
(74) *Attorney, Agent, or Firm* — Canon U.S.A. Inc., IP Division

(57) ABSTRACT

An electrophotographic photosensitive member includes a support, an undercoat layer formed on the support, and a photosensitive layer formed on the undercoat layer. The undercoat layer is an electron transporting layer and contains a metal salt of organic acid having at least one metal element selected from Fe, Co, Ni, Cu, and Zn.

15 Claims, 4 Drawing Sheets

(56) References Cited

U.S. PATENT DOCUMENTS

| | | | | |
|---|---|---|---|---|
| 4,992,349 | A | 2/1991 | Chen | |
| 5,468,583 | A | 11/1995 | Gruenbaum | |
| 5,795,690 | A | 8/1998 | Takegawa | |
| 6,143,453 | A * | 11/2000 | Sugimura et al. | 430/65 |
| 2003/0190540 | A1 * | 10/2003 | Shoshi et al. | 430/78 |
| 2008/0220356 | A1 | 9/2008 | Yamada | |

FOREIGN PATENT DOCUMENTS

| | | | |
|---|---|---|---|
| JP | 0770038 | A | 3/1995 |
| JP | H07225449 | A | 8/1995 |
| JP | 09151157 | A | 6/1997 |
| JP | 09197701 | A | 7/1997 |
| JP | 2001083726 | A | 3/2001 |
| JP | 2003345044 | A | 12/2003 |

OTHER PUBLICATIONS

Pilpel, N., "Properties of Organic Solutions of Heavy Metal Soaps", Chemical Reviews, 1963, pp. 221-234, vol. 63(3) American Chemical Society, 1155 Sixteenth Street, N. W., Washington, 6, D. C.

Jones et al., "Cyanonaphthalene Diimide Semiconductors for Air-Stable, Flexible, and Optically Transparent n-Channel Field-Effect Transistors", Chemistry of Materials, May 29, 2007, pp. 2703-2705, vol. 19 No. 11.

Callahan et al., "Syntheses of Phencyclone Analogues. Applications for NMR Studies of Hindered Rotations and Magnetic Anisotropy in Crowded Diels-Alder Adducts", Chem. Educator, 2001, pp. 227-234, vol. 6.

Yamada et al., "Synthesis and Properties of Diamino-Substituted Dipyrido [3,2-a: 2',3'-c]phenazine", Bull. Chem. Soc. Jpn., 1992, pp. 1006-1011, vol. 65, No. 4.

Qian et al., "4-Amino-1,8-dicyanonaphthalene derivatives as novel fluorophore and fluorescence switches: efficient synthesis and fluorescence enhancement induced by transition metal ions and protons", Tetrahedron Letters, 2002, pp. 2991-2994, vol. 43.

Xiao et al., "Novel highly efficient fluoroionophores with a peri-effect and strong electron-donating receptors: TICT-promoted PET and signaling response to transition metal cations with low background emission", Tetrahedron Letters, 2003, pp. 2087-2091, vol. 44.

Miyamura et al., "Polymer Incarcerated Gold Catalyzed Aerobic Oxidation of Hydroquinones and Their Derivatives", Chemistry Letters, 2008, pp. 360-361, vol. 37 No. 3.

Okada et al., Synthesis and Properties of a Novel Electron Transporting Compound, 3,3'-dialky1-4,4'-bisnaphthylquinone (DBNQ), PPCI Japan, 1998 p. 207-210.

Jones et al., "Turning Orbital Energetics in Arylene Diimide Semiconductors. Materials Design for Ambient Stability of n-Type Charge transport", Journal of the American Chemical Society, Nov. 14, 2007, pp. 15259-15278, vol. 129, No. 49.

Kato et al., "Nitration of Phenanthrenequinone" 1957, pp. 29-34, vol. 15.

Partial Translation of Kato et al., "Nitration of Phenanthrenequinone" pp. 29-34.

* cited by examiner

ELECTROPHOTOGRAPHIC PHOTOSENSITIVE MEMBER, METHOD OF PRODUCING ELECTROPHOTOGRAPHIC PHOTOSENSITIVE MEMBER, PROCESS CARTRIDGE, AND ELECTROPHOTOGRAPHIC APPARATUS

BACKGROUND OF THE INVENTION

1. Field of the Invention

The present invention relates to an electrophotographic photosensitive member, a method of producing an electrophotographic photosensitive member, and a process cartridge and an electrophotographic apparatus that include an electrophotographic photosensitive member.

2. Description of the Related Art

Electrophotographic photosensitive members that contain organic photoconductive substances are mainly used as electrophotographic photosensitive members installed in process cartridges and electrophotographic apparatuses. Such electrophotographic photosensitive members have good film-forming properties and can be produced by coating, and thus are advantageous in that productivity of the electrophotographic photosensitive members is high.

An electrophotographic photosensitive member typically includes a support and a photosensitive layer formed on the support. Furthermore, an undercoat layer is often provided between the support and the photosensitive layer in order to suppress charge injection from the support side to the photosensitive layer side and to suppress occurrence of image defects such as black dots.

In recent years, charge generating substances having higher sensitivity have been used in electrophotographic photosensitive members.

However, as the sensitivity of the charge generating substances increases and the amount of charges generated increases, charges tend to remain in the photosensitive layers, resulting in a problem called ghosting. Specifically, a phenomenon so-called positive ghosting in which only the density of a portion irradiated with light during the previous rotation is increased in an output image tends to occur. To address this problem, techniques for suppressing a change in the potential are disclosed in which an undercoat layer having an electron transporting capability (hereinafter, also referred to as "electron transporting layer") is provided by incorporating an electron transporting compound in the undercoat layer.

Japanese Patent Laid-Open Nos. 2001-83726 and 2003-345044 describe techniques for suppressing the positive ghosting by incorporating an electron transporting compound such as an imide compound in an undercoat layer.

Japanese Patent Laid-Open No. 9-197701 describes a technique for suppressing the positive ghosting by incorporating an electron transporting compound and an organometallic compound having a metal element such as Zr or Ti in an undercoat layer.

In recent years, requirements for the quality of electrophotographic images have become higher and the permissible range for the positive ghosting has also become narrower. As a result of intensive studies conducted by the inventors of the present invention, it was found that the techniques disclosed in Japanese Patent Laid-Open Nos. 2001-83726, 2003-345044, and 9-197701 may not sufficiently suppress initial positive ghosting and have room for further improvements with regard to the suppression of initial positive ghosting.

SUMMARY OF THE INVENTION

Aspect of the present invention may provide an electrophotographic photosensitive member that suppresses initial positive ghosting, a method of producing the electrophotographic photosensitive member, and a process cartridge and an electrophotographic apparatus that include the electrophotographic photosensitive member.

A first aspect of the present invention provides an electrophotographic photosensitive member including a support, an undercoat layer formed on the support, and a photosensitive layer formed on the undercoat layer. The undercoat layer is an electron transporting layer, and the undercoat layer includes a metal salt of organic acid having at least one metal element selected from the group consisting of Fe, Co, Ni, Cu, and Zn.

A second aspect of the present invention provides a process cartridge detachably attached to a main body of an electrophotographic apparatus. The process cartridge integrally supports the electrophotographic photosensitive member described above, and at least one device selected from the group consisting of a charging device, a developing device, a transferring device, and a cleaning device.

A third aspect of the present invention provides an electrophotographic apparatus including the electrophotographic photosensitive member described above, a charging device, an exposure device, a developing device, and a transferring device.

A fourth aspect of the present invention provides a method of producing an electrophotographic photosensitive member which includes a support, an undercoat layer formed on the support, and a photosensitive layer formed on the undercoat layer. The method includes the steps of preparing an undercoat layer coating liquid containing a metal salt of organic acid having at least one metal element selected from the group consisting of Fe, Co, Ni, Cu, and Zn, forming a coat of the undercoat layer coating liquid, and drying the coat to form the undercoat layer. In this method, the undercoat layer is an electron transporting layer.

According to the first to fourth aspects of the present invention, it is possible to provide an electrophotographic photosensitive member that suppresses initial positive ghosting, a method of producing the electrophotographic photosensitive member, and a process cartridge and an electrophotographic apparatus that include the electrophotographic photosensitive member.

Further features of the present invention will become apparent from the following description of exemplary embodiments with reference to the attached drawings.

DESCRIPTION OF THE EMBODIMENTS

Figure 1:
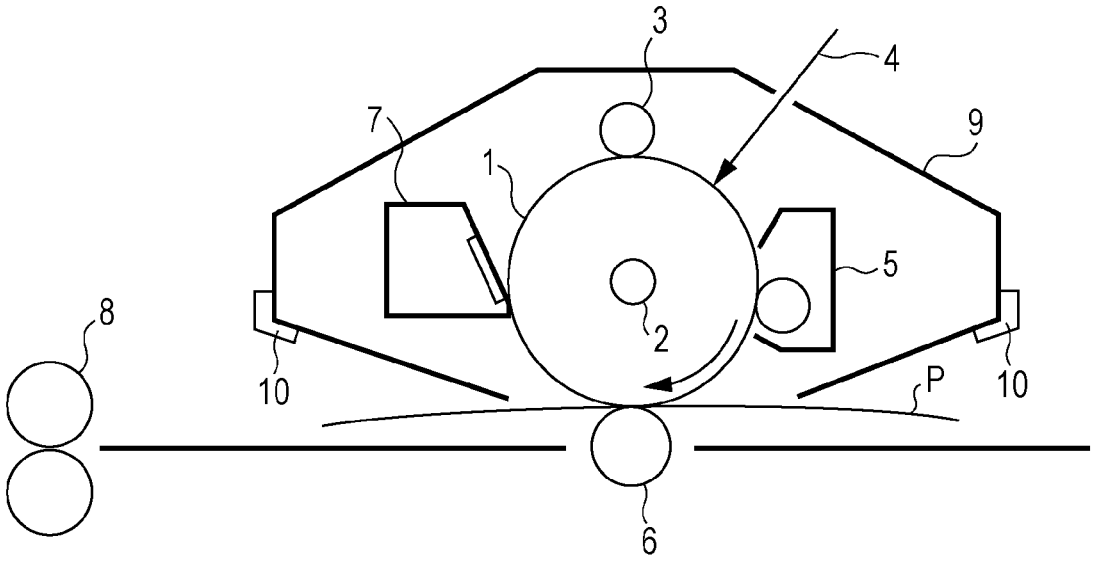
FIG. 1 is a schematic view illustrating a structure of an electrophotographic apparatus that includes a process cartridge including an electrophotographic photosensitive member.

According to an embodiment of the present invention, an undercoat layer of an electrophotographic photosensitive member is an electron transporting layer and contains a metal salt of organic acid (organic acid metal) having at least one metal element selected from the group consisting of Fe, Co, Ni, Cu, and Zn.

The inventors of the present invention believe that the reason why the above electrophotographic photosensitive member suppresses initial positive ghosting is as follows.

The undercoat layer is an electron transporting layer and thus has a function of promoting transport of electrons and suppressing the remaining of electrons. Furthermore, it is believed that, by incorporating a metal salt of organic acid having at least one metal element selected from the group consisting of Fe, Co, Ni, Cu, and Zn in the undercoat layer, the flow of electrons in the undercoat layer is promoted and an undercoat layer that can more easily transport electrons can be formed. It is believed that when the flow of electrons is promoted, the remaining of electrons in the undercoat layer is suppressed, thereby suppressing initial positive ghosting.

In the technique disclosed in Japanese Patent Laid-Open No. 9-197701, Zr, Ti, Sn, etc. are used as metal elements of the organometallic compound incorporated in an undercoat layer which is an electron transporting layer. Chemical Reviews, 63(3), 221-234 (1963) describes the value of the dipole moment of a metal salt of fatty acid (which is a type of metal salt of organic acid). Referring to this document, it is believed that with the decrease in the period number of the periodic table of elements, and in transition elements, with an increase in the group number of the periodic table, the polarity of the metal element tends to decrease. Note that the term "transition elements" refers to D-block elements (the fourth period elements): elements ranging from group 3 elements to group 12 elements. Accordingly, it is believed that organometallic compounds having the above metal elements (such as Zr, Ti, and Sn) have polarities higher than those of metal salts of organic acids having metal elements selected from Fe, Co, Ni, Cu, and Zn. It is believed that when an organometallic compound having a high polarity is incorporated in an undercoat layer, electrons are trapped in the metal element of the organometallic compound, the metal element having the high polarity, and the flow of electrons in the undercoat layer tends to decrease. It is believed that initial positive ghosting thus occurs.

The electrophotographic photosensitive member according to an embodiment of the present invention includes a support, an undercoat layer formed on the support, and a photosensitive layer formed on the undercoat layer. The photosensitive layer may be a layered-type (function-separated) photosensitive layer including a charge generating layer containing a charge generating substance and a hole transporting layer containing a hole transporting substance.

Figure 4A:
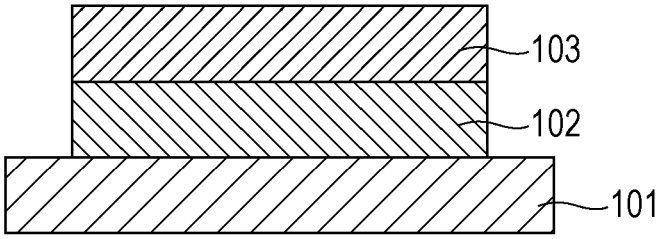
FIGS. 4A and 4B are views illustrating examples of the layer structure of an electrophotographic photosensitive member.
Figure 4B:
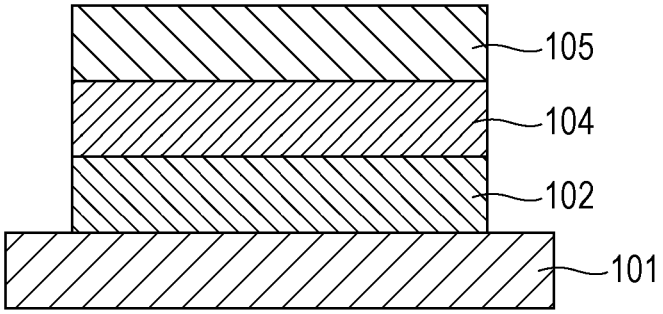

FIGS. 4A and 4B are views illustrating examples of the layer structure of the electrophotographic photosensitive member. An electrophotographic photosensitive member illustrated in FIG. 4A includes a support 101, an undercoat layer 102, and a photosensitive layer 103. An electrophotographic photosensitive member illustrated in FIG. 4B includes a support 101, an undercoat layer 102, a charge generating layer 104, and a hole transporting layer 105.

A cylindrical electrophotographic photosensitive member produced by forming a photosensitive layer (charge generating layer and hole transporting layer) on a cylindrical support is widely used as a typical electrophotographic photosensitive member. Alternatively, the electrophotographic photosensitive member may have a belt shape, a sheet shape, or the like.

Undercoat Layer

An undercoat layer is provided between a support and a photosensitive layer or between a conductive layer and a photosensitive layer.

An electron transporting layer functioning as an undercoat layer is a layer having a function of allowing electrons to flow from the photosensitive layer side to the support side. Specifically, the electron transporting layer may be a cured layer obtained by curing an electron transporting compound or a composition containing an electron transporting compound, or a layer containing an electron transporting compound. In the case where the electron transporting layer is a layer containing an electron transporting compound, the electron transporting compound may be a pigment.

The composition may further contain a resin and a cross-linking agent, and the cured layer may be obtained by curing this composition. In the case where the electron transporting layer is a cured layer, the electron transporting compound and the resin may be an electron transporting compound having a polymerizable functional group and a resin having a polymerizable functional group, respectively. Examples of the polymerizable functional group include a hydroxy group, a thiol group, an amino group, a carboxyl group, and a methoxy group.

Examples of the electron transporting compound (electron transporting pigment) include quinone compounds, imide compounds, benzimidazole compounds, and cyclopentadienylidene compounds.

Specific examples of the electron transporting compounds and the electron transporting compounds having a polymerizable functional group are shown below. However, the electron transporting compounds are not limited thereto. Examples thereof include compounds represented by any of formulae (A1) to (A9) below.

(A1)

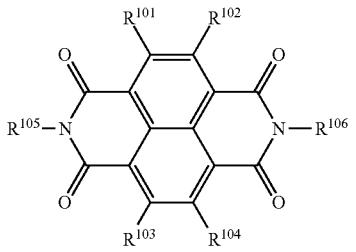

(A2)

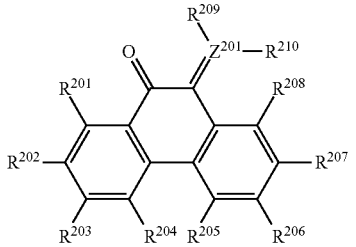

(A3)

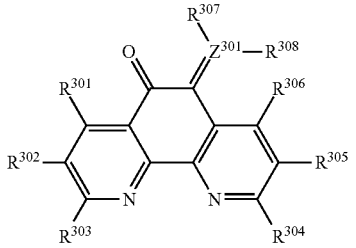

-continued (A4)

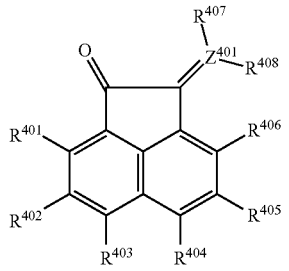

(A5)

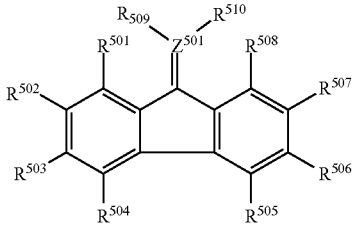

(A6)

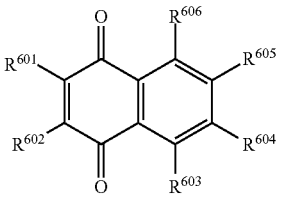

(A7)

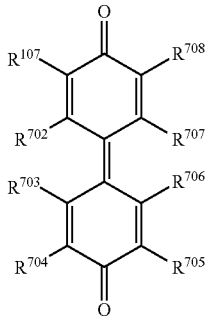

(A8)

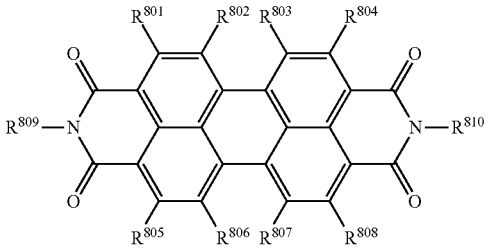

(A9)

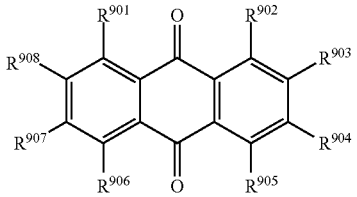

In formulae (A1) to (A9), $R^{101}$ to $R^{106}$, $R^{201}$ to $R^{210}$, $R^{301}$ to $R^{308}$, $R^{401}$ to $R^{408}$, $R^{501}$ to $R^{510}$, $R^{601}$ to $R^{606}$, $R^{701}$ to $R^{708}$, $R^{801}$ to $R^{810}$, and $R^{901}$ to $R^{908}$ each independently represent a monovalent group represented by formula (A) below, a hydrogen atom, a cyano group, a nitro group, a halogen atom, an alkoxycarbonyl group, a substituted or unsubstituted alkyl group, a substituted or unsubstituted aryl group, or a heterocyclic ring. One of the carbon atoms in the main chain of the alkyl group may be substituted with O, S, NH, or $NR^1$ (where $R^1$ is an alkyl group). The substituent of the substituted alkyl group is a group selected from the group consisting of alkyl groups, aryl groups, alkoxycarbonyl groups, and halogen atoms. The substituent of the substituted aryl group and the substituent of the substituted heterocyclic ring are groups selected from the group consisting of halogen atoms, a nitro group, a cyano group, alkyl groups, halogen-substituted alkyl groups, alkoxy groups, and a carbonyl group. $Z^{201}$, $Z^{301}$, $Z^{401}$, and $Z^{501}$ each independently represent a carbon atom, a nitrogen atom, or an oxygen atom. When $Z^{201}$ is an oxygen atom, $R^{209}$ and $R^{210}$ are not present. When $Z^{201}$ is a nitrogen atom, $R^{210}$ is not present. When $Z^{301}$ is an oxygen atom, $R^{307}$ and $R^{308}$ are not present. When $Z^{301}$ is a nitrogen atom, $R^{308}$ is not present. When $Z^{401}$ is an oxygen atom, $R^{407}$ and $R^{408}$ are not present. When $Z^{401}$ is a nitrogen atom, $R^{408}$ is not present. When $Z^{501}$ is an oxygen atom, $R^{509}$ and $R^{510}$ are not present. When $Z^{501}$ is a nitrogen atom, $R^{510}$ is not present.

(A)

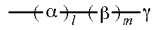

In formula (A), at least one of α, β, and γ is a group having a substituent, and the substituent is at least one group selected from the group consisting of a hydroxy group, a thiol group, an amino group, a carboxyl group, and a methoxy group. l and m each independently represent 0 or 1, and the sum of l and m is 0 or more and 2 or less.

In formula (A), α represents an alkylene group whose main chain has 1 to 6 atoms, an alkylene group whose main chain has 1 to 6 atoms and which is substituted with an alkyl group having 1 to 6 carbon atoms, an alkylene group whose main chain has 1 to 6 atoms and which is substituted with a benzyl group, an alkylene group whose main chain has 1 to 6 atoms and which is substituted with an alkoxycarbonyl group, or an alkylene group whose main chain has 1 to 6 atoms and which is substituted with a phenyl group. These groups may have at least one group selected from the group consisting of a hydroxy group, a thiol group, an amino group, a carboxyl group, and a methoxy group. One of the carbon atoms in the main chain of the alkylene group may be substituted with O, S, NH, or $NR^2$ (where $R^2$ is an alkyl group).

In formula (A), β represents a phenylene group, a phenylene group substituted with an alkyl group having 1 to 6 carbon atoms, a nitro-substituted phenylene group, a halogen-substituted phenylene group, or a phenylene group substituted with an alkoxy group. These groups may have at least one group selected from the group consisting of a hydroxy group, a thiol group, an amino group, a carboxyl group, and a methoxy group.

In formula (A), γ represents a hydrogen atom, an alkyl group having 1 to 6 carbon atoms, or an alkyl group whose main chain has 1 to 6 atoms and which is substituted with an alkyl group having 1 to 6 carbon atoms. These groups may have at least one group selected from the group consisting of a hydroxy group, a thiol group, an amino group, a carboxyl group, and a methoxy group. One of the carbon atoms in the main chain of the alkyl group may be substituted with $NR^3$ (where $R^3$ is an alkyl group).

The compounds represented by formulae (A1) to (A9) may form multimers, polymers, and copolymers.

Table 1 shows specific examples of the compound represented by formula (A1) above. In Table 1, A1-1 to A1-6 and A1-9 to A1-14 are electron transporting compounds each having a polymerizable functional group.

TABLE 1
| Exemplary compound | Structural formula |
|---|---|
| A1-1 | 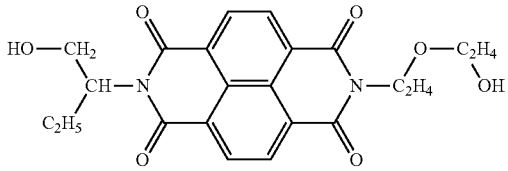 |
| A1-2 | 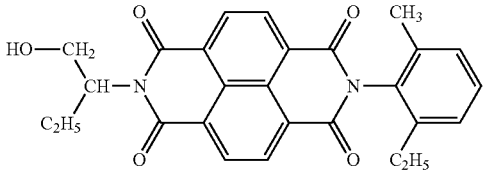 |
| A1-3 | 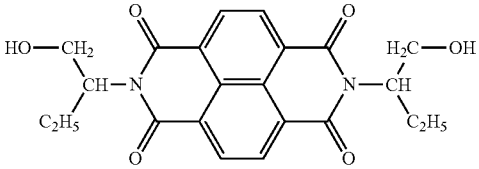 |
| A1-4 | 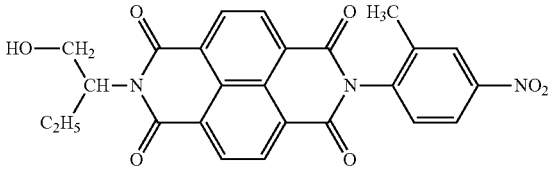 |
| A1-5 | 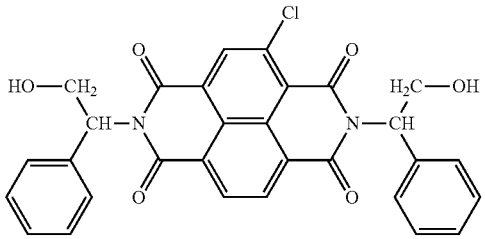 |
| A1-6 | 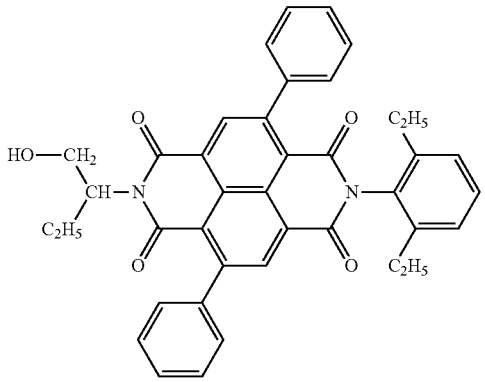 |
| A1-7 | 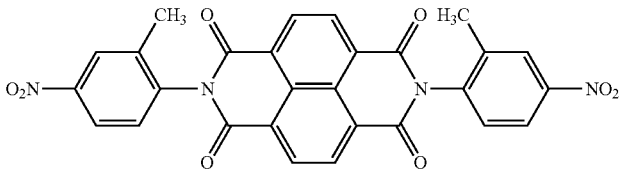 |

TABLE 1-continued
| Exemplary compound | Structural formula |
|---|---|
| A1-8 | 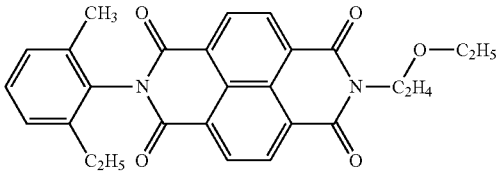 |
| A1-9 | 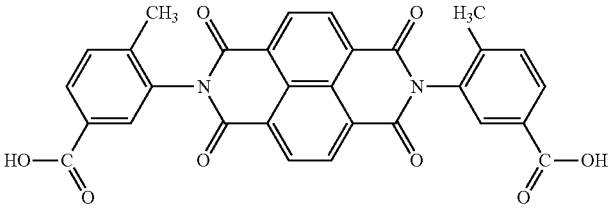 |
| A1-10 | 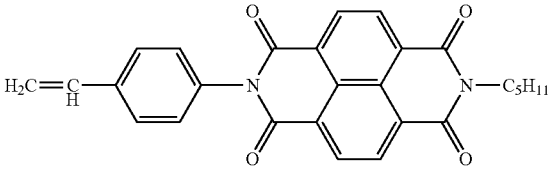 |
| A1-11 | 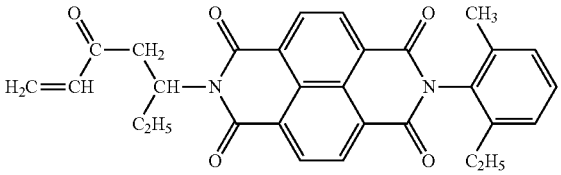 |
| A1-12 | 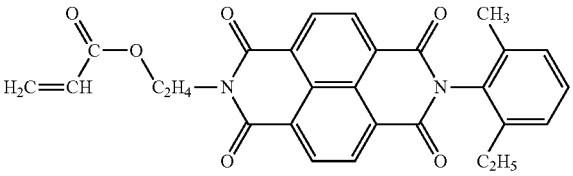 |
| A1-13 | 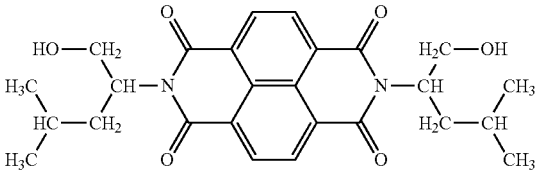 |
| A1-14 | 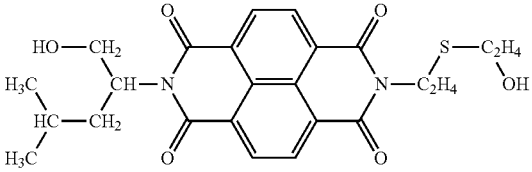 |
Table 2 shows specific examples of the compound represented by formula (A2) above. In Table 2, A2-1, A2-2, A2-4, and A2-5 are electron transporting compounds each having a polymerizable functional group.

TABLE 2
| Exemplary compound | Structural formula |
|---|---|
| A2-1 | 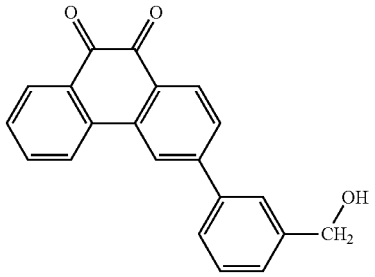 |
| A2-2 | 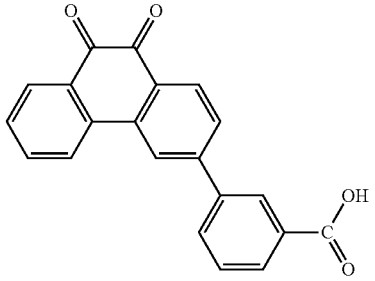 |
| A2-3 | 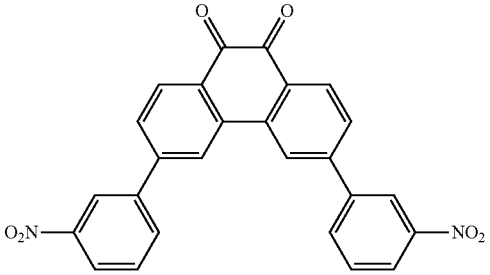 |
TABLE 2-continued
| Exemplary compound | Structural formula |
|---|---|
| A2-4 | 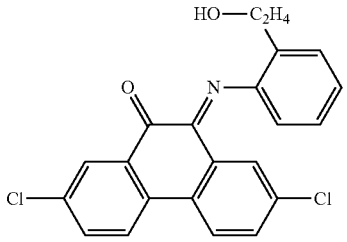 |
| A2-5 | 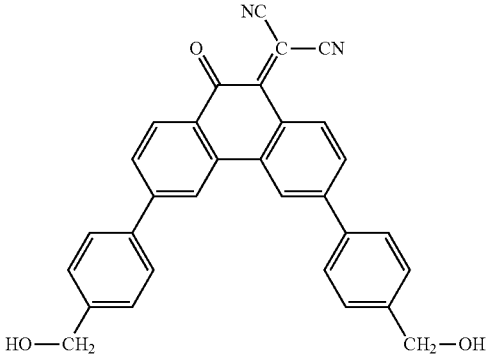 |
Table 3 shows specific examples of the compound represented by formula (A3) above. In Table 3, A3-1 to A3-5 are electron transporting compounds each having a polymerizable functional group.
TABLE 3
| Exemplary compound | Structural formula |
|---|---|
| A3-1 | 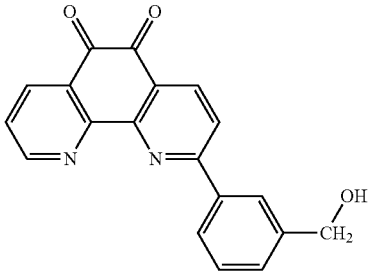 |
| A3-2 | 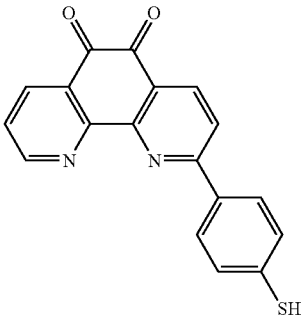 |

TABLE 3-continued
| Exemplary compound | Structural formula |
|---|---|
| A3-3 | 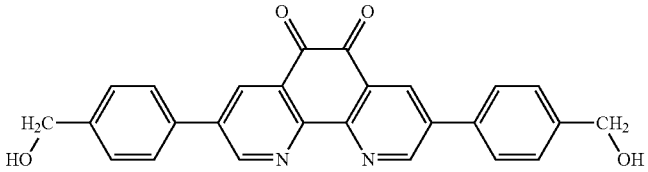 |
| A3-4 | 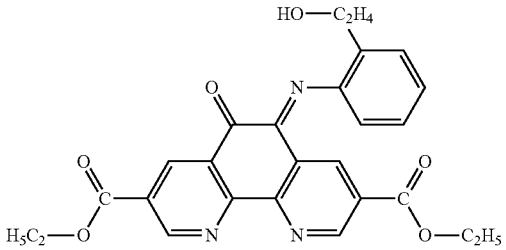 |
| A3-5 | 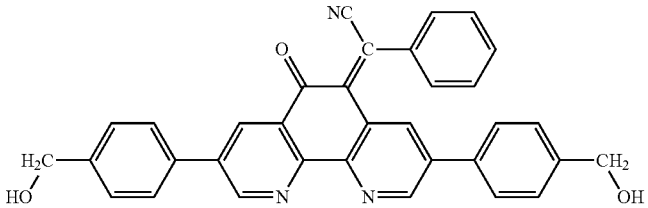 |
Table 4 shows specific examples of the compound represented by formula (A4) above. In Table 4, A4-2 to A4-5 are electron transporting compounds each having a polymerizable functional group.
TABLE 4
| Exemplary compound | Structural formula |
|---|---|
| A4-1 | 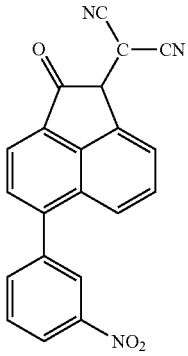 |
| A4-2 | 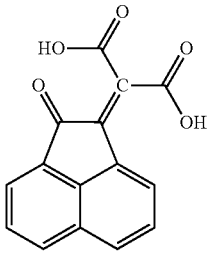 |
TABLE 4-continued
| Exemplary compound | Structural formula |
|---|---|
| A4-3 | 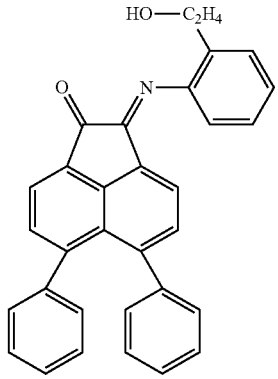 |
| A4-4 | 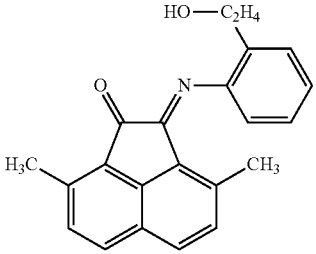 |

TABLE 4-continued
| Exemplary compound | Structural formula |
|---|---|
| A4-5 | 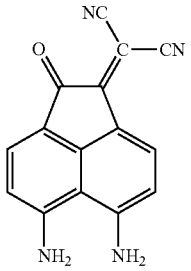 |
Table 5 shows specific examples of the compound represented by formula (A5) above. In Table 5, A5-1 to A5-5 are electron transporting compounds each having a polymerizable functional group.
TABLE 5
| Exemplary compound | Structural formula |
|---|---|
| A5-1 | 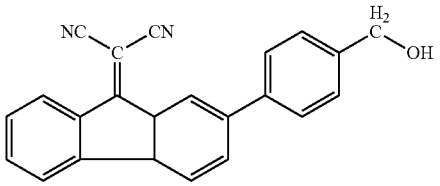 |
| A5-2 | 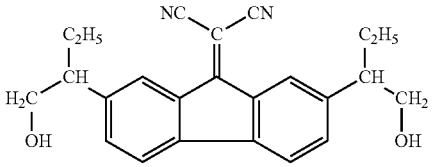 |
| A5-3 | 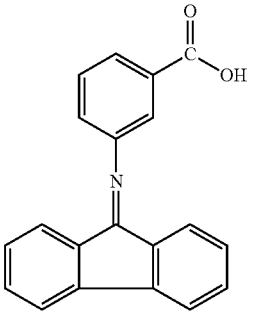 |

TABLE 5-continued

| Exemplary compound | Structural formula |
|---|---|
| A5-4 | 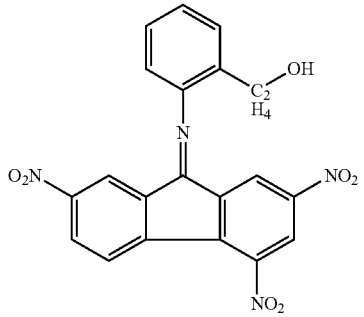 |
| A5-5 | 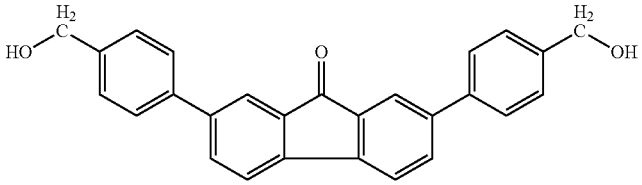 |

Table 6 shows specific examples of the compound represented by formula (A6) above. In Table 6, A6-1, and A6-3 to A6-5 are electron transporting compounds each having a polymerizable functional group.

TABLE 6

| Exemplary compound | Structural formula |
|---|---|
| A6-1 | 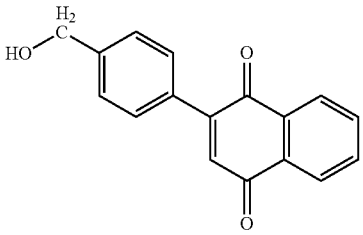 |
| A6-2 | 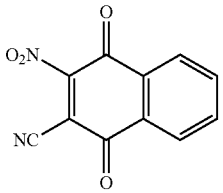 |

TABLE 6-continued

| Exemplary compound | Structural formula |
|---|---|
| A6-3 | 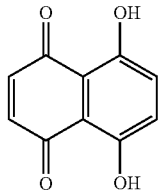 |
| A6-4 | 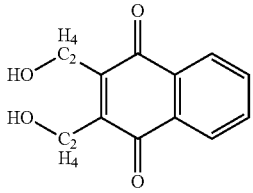 |
| A6-5 | 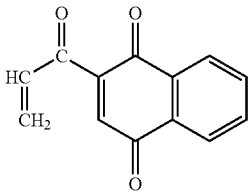 |

Table 7 shows specific examples of the compound represented by formula (A7) above. In Table 7, A7-1, and A7-3 to A7-5 are electron transporting compounds each having a polymerizable functional group.

TABLE 7
| Exemplary compound | Structural formula |
|---|---|
| A7-1 | 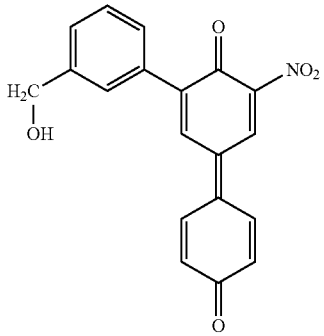 |
| A7-2 | 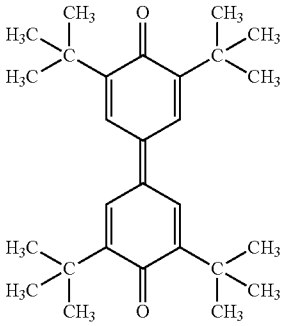 |
| A7-3 | 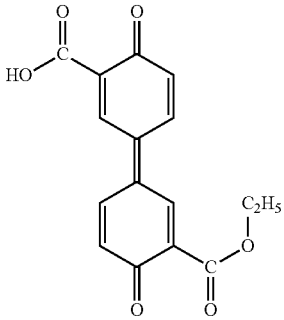 |
TABLE 7-continued
| Exemplary compound | Structural formula |
|---|---|
| A7-4 | 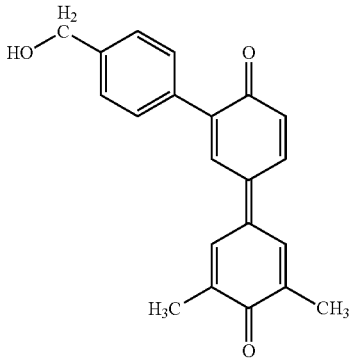 |
| A7-5 | 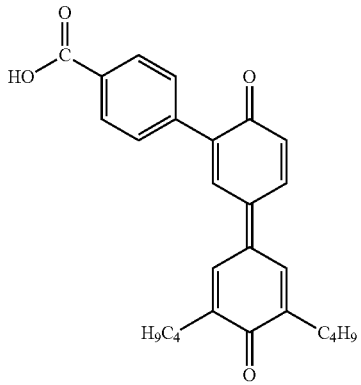 |
Table 8 shows specific examples of the compound represented by formula (A8) above. In Table 8, A8-1, A8-2, A8-4, and A8-5 are electron transporting compounds each having a polymerizable functional group.
TABLE 8
| Exemplary compound | Structural formula |
|---|---|
| A8-1 | 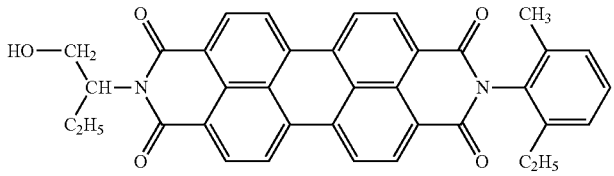 |
| A8-2 | 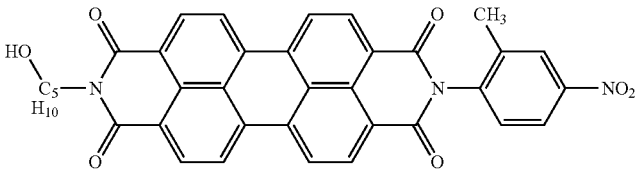 |

TABLE 8-continued
| Exemplary compound | Structural formula |
|---|---|
| A8-3 | 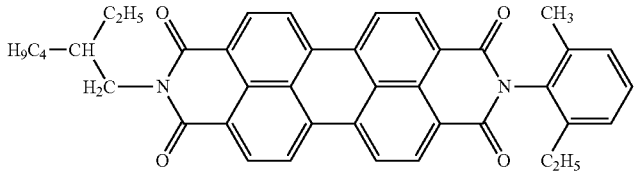 |
| A8-4 | 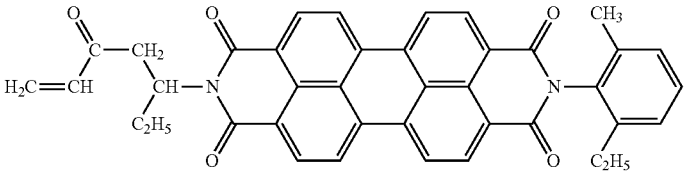 |
| A8-5 | 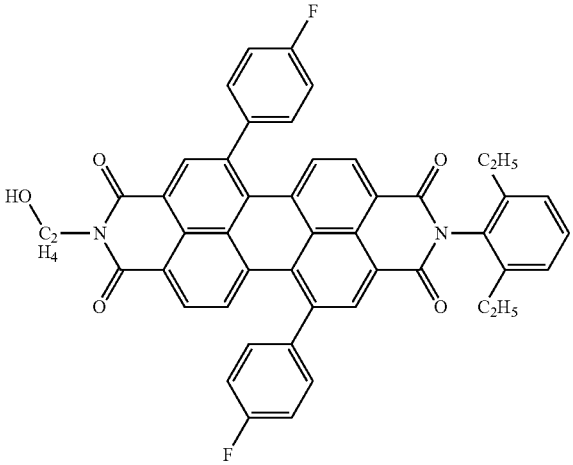 |
Table 9 shows specific examples of the compound represented by formula (A9) above. In Table 9, A9-1 to A9-5 are electron transporting compounds each having a polymerizable functional group.
TABLE 9
| Exemplary compound | Structural formula |
|---|---|
| A9-1 | 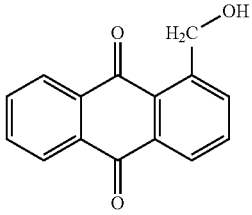 |
TABLE 9-continued
| Exemplary compound | Structural formula |
|---|---|
| A9-2 | 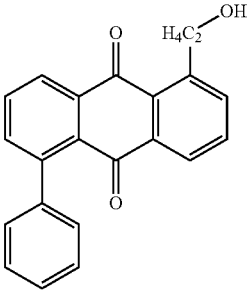 |

TABLE 9-continued

| Exemplary compound | Structural formula |
|---|---|
| A9-3 | 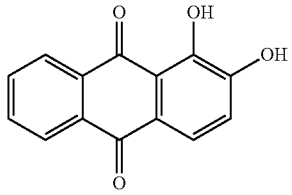 |
| A9-4 | 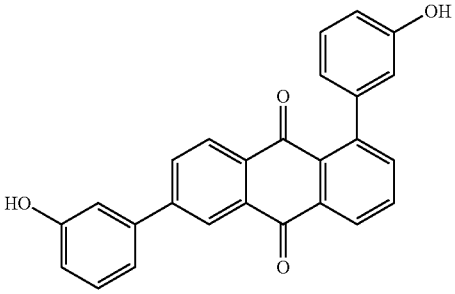 |
| A9-4 | 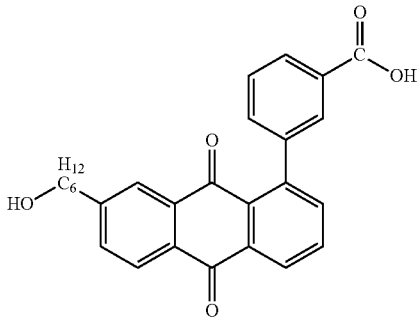 |

Derivatives having a structure (A1) (derivatives of the electron transporting compound) can be synthesized by, for example, known synthetic methods such as those described in U.S. Pat. Nos. 4,442,193, 4,992,349, and 5,468,583 and Chemistry of materials, Vol. 19, No. 11, pp. 2703-2705 (2007). The derivatives can also be synthesized by a reaction between a naphthalene tetracarboxylic dianhydride and a monoamine derivative that are commercially available from Tokyo Chemical Industry Co., Ltd., Sigma-Aldrich Japan K.K., and Johnson Matthey Japan Incorporated.

Derivatives having a structure (A2) (derivatives of the electron transporting compound) are commercially available from, for example, Tokyo Chemical Industry Co., Ltd., Sigma-Aldrich Japan K.K., and Johnson Matthey Japan Incorporated. The derivatives can also be synthesized from phenanthrene derivatives or phenanthroline derivatives by synthetic methods described in Chem. Educator No. 6, pp. 227-234 (2001), Journal of Synthetic Organic Chemistry, Japan, Vol. 15, pp. 29-32 (1957), and Journal of Synthetic Organic Chemistry, Japan, Vol. 15, pp. 32-34 (1957). A dicyanomethylene group can be introduced by a reaction with malononitrile.

Derivatives having a structure (A3) (derivatives of the electron transporting compound) are commercially available from, for example, Tokyo Chemical Industry Co., Ltd., Sigma-Aldrich Japan K.K., and Johnson Matthey Japan Incorporated. The derivatives can also be synthesized from phenanthrene derivatives or phenanthroline derivatives by a synthetic method described in Bull. Chem. Soc. Jpn., Vol. 65, pp. 1006-1011 (1992). A dicyanomethylene group can also be introduced by a reaction with malononitrile.

Derivatives having a structure (A4) (derivatives of the electron transporting compound) are commercially available from, for example, Tokyo Chemical Industry Co., Ltd., Sigma-Aldrich Japan K.K., and Johnson Matthey Japan Incorporated. The derivatives can also be synthesized from acenaphthenequinone derivatives by synthetic methods described in Tetrahedron Letters, 43(16), pp. 2991-2994 (2002) and Tetrahedron Letters, 44(10), pp. 2087-2091 (2003). A dicyanomethylene group can also be introduced by a reaction with malononitrile.

Derivatives having a structure (A5) (derivatives of the electron transporting compound) are commercially available from, for example, Tokyo Chemical Industry Co., Ltd., Sigma-Aldrich Japan K.K., and Johnson Matthey Japan Incorporated. The derivatives can also be synthesized by a synthetic method described in U.S. Pat. No. 4,562,132 by using a fluorenone derivative and malononitrile. The derivatives can also be synthesized by synthetic methods described in Japanese Patent Laid-Open Nos. 5-279582 and 7-70038 by using fluorenone derivatives and aniline derivatives.

Derivatives having a structure (A6) (derivatives of the electron transporting compound) can be synthesized by, for example, synthetic methods described in Chemistry Letters, 37(3), pp. 360-361 (2008) and Japanese Patent Laid-Open No. 9-151157. The derivatives are also commercially available from Tokyo Chemical Industry Co., Ltd., Sigma-Aldrich Japan K.K., and Johnson Matthey Japan Incorporated.

Derivatives having a structure (A7) (derivatives of the electron transporting compound) can be synthesized by synthetic methods described in Japanese Patent Laid-Open No. 1-206349 and PPCI/Japan Hard Copy '98 proceedings, p. 207 (1998). The derivatives can also be synthesized by using, as raw materials, phenol derivatives commercially available from Tokyo Chemical Industry Co. Ltd. and Sigma-Aldrich Japan K.K.

Derivatives having a structure (A8) (derivatives of the electron transporting compound) can be synthesized by, for example, a known synthetic method described in Journal of the American chemical society, Vol. 129, No. 49, pp. 15259-15278 (2007). The derivatives can also be synthesized by a reaction between perylene tetracarboxylic dianhydride and a monoamine derivative that are commercially available from Tokyo Chemical Industry Co., Ltd., Sigma-Aldrich Japan K.K., and Johnson Matthey Japan Incorporated.

Derivatives having a structure (A9) (derivatives of the electron transporting compound) are commercially available from, for example, Tokyo Chemical Industry Co., Ltd., Sigma-Aldrich Japan K.K., and Johnson Matthey Japan Incorporated.

The undercoat layer contains a metal salt of organic acid having at least one metal element selected from the group consisting of Fe, Co, Ni, Cu, and Zn. The metal salt of organic acid may be a metal complex of organic acid. Among the metal elements of the metal salt of organic acid, Ni and Zn are preferable. The bandgap (which is determined by 1239/X (eV) where X (nm) represents the wavelength of an absorption edge of an ultraviolet-visible absorption spectrum) of a metal salt of organic acid having Ni or Zn is wider than that of a metal salt of organic acid having Fe, Co, or Cu. Thus, Ni and Zn further suppress the trapping of electrons flowing in the undercoat layer, and it is believed that positive ghosting is further suppressed.

The organic acid of the metal salt of organic acid is preferably a monovalent carboxylic acid, and more preferably a fatty acid. When the monovalent carboxylic acid is a fatty acid, which does not have a ring structure more rigid than a chain structure, the bulk around the metal element becomes small. Accordingly, it is believed that the flow of electrons in the undercoat layer is further promoted by considering the configuration of the organic acid around the metal element. The fatty acid may have a linear chain structure or a branched chain structure, and may be a saturated fatty acid or an unsaturated fatty acid.

More preferably, the fatty acid has 4 to 8 carbon atoms. In this case, it is believed that the effect of assisting the flow of electrons in the electron transporting layer can be sufficiently obtained. Examples of the fatty acid having 4 to 8 carbon atoms include butyric acid, isobutyric acid, valeric acid, isovaleric acid, hexanoic acid, heptanoic acid, octanoic acid, and octylic acid.

Specific examples of the metal salt of organic acid include zinc(II) octylate, zinc(II) butyrate, zinc(II) hexanoate, zinc (II) octanoate, nickel(II) octylate, nickel(II) octanoate, zinc (II) formate, zinc(II) propionate, zinc(II) laurate, iron(III) octylate, cobalt(II) octylate, copper(II) octylate, iron(III) naphthenate, cobalt(II) naphthenate, copper(II) naphthenate, zinc(II) naphthenate, zinc(II) benzoate, zinc(II) oxalate, zinc (II) citrate, zinc(II) tartrate, and zinc(II) p-toluenesulfonate.

The content of the metal salt of organic acid is preferably 0.1% by mass or more and 5% by mass or less relative to the mass of the undercoat layer. It is believed that when the content of the metal salt of organic acid is within this range, the above-described effect of assisting the flow of electrons, the effect being achieved by the metal salt of organic acid, can be sufficiently obtained.

The content of the metal salt of organic acid in an undercoat layer can be determined by, for example, measuring the undercoat layer by elemental analysis using X-ray fluorescence (XRF) because the metal salt of organic acid contains a metal element. In the case where this measuring method is employed, it is necessary to separate a photosensitive layer, or a hole transporting layer and a charge generating layer, and then to separate and collect the undercoat layer. Examples of the method for separating the photosensitive layer or the hole transporting layer and the charge generating layer include a method in which immersion and separation are performed by using a solvent that dissolves these layers but that does not easily dissolve the undercoat layer, and a method in which separation is performed by polishing. The layers may be separated by using these methods in combination.

Resin

Next, resins will be described. Examples of the resins used in the undercoat layer include butyral resins, alkyd resins, polyamide resins, polyolefin resins, polyvinyl acetal resins, polyvinyl resins, and polyester resins. When the undercoat layer (electron transporting layer) is a cured layer obtained by curing a composition containing an electron transporting compound having a polymerizable functional group, a resin, and a cross-linking agent, the resin may be a thermoplastic resin having a polymerizable functional group.

The thermoplastic resin having a polymerizable functional group is preferably a thermoplastic resin including a structural unit represented by formula (D) below.

(D)

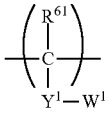

In formula (D), $R^{61}$ represents a hydrogen atom or an alkyl group, $Y^1$ represents a single bond, an alkylene group, or a phenylene group, and $W^1$ represents a hydroxy group, a thiol group, an amino group, a carboxyl group, or a methoxy group.

Resins including a structural unit represented by formula (D) (hereinafter also referred to as "resins D") are obtained by polymerizing monomers having a polymerizable functional group, the monomers being commercially available from, for example, Sigma-Aldrich Japan K.K. and Tokyo Chemical Industry Co., Ltd. Examples of the polymerizable functional group include a hydroxy group, a thiol group, an amino group, a carboxyl group, and a methoxy group.

The resins are also commercially available. Examples of the commercially available resins include polyether polyol resins such as AQD-457 and AQD-473 manufactured by Nippon Polyurethane Industry Co., Ltd. and SANNIX GP-400 and GP-700 manufactured by Sanyo Chemical Industries, Ltd.; polyester polyol resins such as Phthalkyd W2343 manufactured by Hitachi Chemical Co., Ltd., Watersol S-118 and CD-520 and Beckolite M-6402-50 and M-6201-401M, all of which are manufactured by DIC Corporation, Haridip WH-1188 manufactured by Harima Chemicals Inc., and ES3604 and ES6538 manufactured by Japan U-Pica Co., Ltd.; polyacrylic polyol resins such as Burnock WE-300 and WE-304 manufactured by DIC Corporation; polyvinyl alcohol resins such as Kuraray Poval PVA-203 manufactured by Kuraray Co., Ltd.; polyvinyl acetal resins such as BX-1, BM-1, KS-1, and KS-5 manufactured by Sekisui Chemical Co., Ltd.; polyamide resins such as Toresin FS-350 manufactured by Nagase ChemteX Corporation; carboxyl group-containing resins such as Aqualic manufactured by Nippon Shokubai Co., Ltd. and Finelex SG2000 manufactured by Namariichi Co., Ltd.; polyamine resins such as Luckamide manufactured by DIC Corporation; and polythiol resins such as QE-340M manufactured by Toray Industries Inc. Among these resins, polyvinyl acetal resins, polyester polyol resins, etc. are more preferable from the standpoint of polymerizability and uniformity of the electron transporting layer.

The weight-average molecular weight of the resin D is preferably in the range of 5,000 to 400,000, and more preferably in the range of 5,000 to 300,000.

Cross-Linking Agent

Next, cross-linking agents will be described.

Compounds that are polymerized (cured) or cross-linked with an electron transporting compound having a polymerizable functional group and a thermoplastic resin having a polymerizable functional group can be used as cross-linking agents. Specifically, for example, compounds described in "Cross-linking Agent Handbook" edited by Shinzo Yamashita and Tosuke Kaneko published by Taiseisha Ltd. (1981) can be used.

The cross-linking agents used in the undercoat layer are preferably isocyanate compounds and amine compounds (derivatives of melamine, guanamine, and urea), and more preferably isocyanate compounds.

Isocyanate compounds having a molecular weight in the range of 200 to 1,300 are preferably used. Furthermore, isocyanate compounds having 3 to 6 isocyanate groups or 3 to 6 blocked isocyanate groups are preferable. Examples of the isocyanate compounds include triisocyanate benzene, triisocyanate methylbenzene, triphenylmethane triisocyanate, and lysine triisocyanate. Examples thereof further include isocyanurate-modified products, biuret-modified products, and allophanate-modified products of tolylene diisocyanate, hexamethylene diisocyanate, dicyclohexylmethane diisocyanate, naphthalene diisocyanate, diphenylmethane diisocyanate, isophorone diisocyanate, xylylene diisocyanate, 2,2,4-trimethylhexamethylene diisocyanate, methyl-2,6-diisocyanatehexanoate, norbornane diisocyanate, or the like, and adduct-modified products of any of these diisocyanates and trimethylolpropane or pentaerythritol. Among these isocyanate compounds, isocyanurate-modified products are more preferable.

The isocyanate compounds may be compounds having a blocked isocyanate group, which is obtained by blocking an isocyanate group.

Amine compounds having an alkylol group such as a methylol group and having a molecular weight in the range of 150 to 1,000 are preferably used as the amine compounds. Amine compounds having a molecular weight in the range of 180 to 560 are more preferable. Examples thereof include melamine derivatives such as hexamethylol melamine, pentamethylol melamine, and tetramethylol melamine; guanamine derivatives such as tetramethylol benzoguanamine and tetramethylolcyclohexyl guanamine; and urea derivatives such as dimethylol dihydroxy ethylene urea, tetramethylol acetylene diurea, and tetramethylol urea. Among these amine compounds, melamine derivatives are more preferable.

All of or some of the alkylol groups in the amine compounds may be alkyl-etherified.

Examples of a solvent used in an undercoat layer coating liquid include alcohol-based solvents, ether-based solvents, ester-based solvents, ketone-based solvents, sulfoxide-based solvents, and aromatic hydrocarbon solvents.

The undercoat layer according to an embodiment of the present invention may contain, in addition to the above compounds, organic substance particles, inorganic substance particles, a leveling agent, etc. to improve the film-forming property and the electrical properties of the undercoat layer. However, the contents of such additives are preferably 50% by mass or less, and more preferably 20% by mass or less relative to the total mass of the undercoat layer.

The undercoat layer may contain metal oxide particles from the standpoint of suppressing (reducing) positive ghosting, which is an advantage of the present invention. However, more preferably, the undercoat layer does not contain metal oxide particles from the standpoints that hole injection from the conductive support side increases and the function of an electron transporting layer tends to decrease, and that black dots are easily generated on an image.

Another layer such as a second undercoat layer that is different from the undercoat layer according to an embodiment of the present invention may be provided between the support and the undercoat layer or between the undercoat layer and the photosensitive layer.

Support

The support may be one having electrical conductivity (conductive support). For example, the support may be composed of a metal such as aluminum, iron, nickel, copper, or gold, or an alloy. Alternatively, a support produced by forming a metal thin film composed of aluminum, chromium, silver, gold, or the like on an insulating support composed of a polyester resin, a polycarbonate resin, a polyimide resin, or glass, or a support produced by forming a thin film composed of a conductive material such as indium oxide or tin oxide on such an insulating support can also be used as the support.

The surface of the support may be subjected to an electrochemical treatment such as anodizing, a wet horning treatment, a blasting treatment, or a cutting treatment to improve the electrical properties and to suppress interference fringes.

A conductive layer may be provided between the support and the undercoat layer. The conductive layer is obtained by forming a coat on a support by applying a conductive layer coating liquid containing a resin and conductive particles dispersed in the resin, and drying the coat. Examples of the conductive particles include carbon black, acetylene black, metal powders such as aluminum, iron, nickel, copper, zinc, and silver powders, and metal oxide powders such as conductive zinc oxide, tin oxide, and indium tin oxide (ITO).

Examples of the resin include polyester resins, polycarbonate resins, polyvinyl butyral resins, acrylic resins, silicone resins, epoxy resins, melamine resins, urethane resins, phenolic resins, and alkyd resins.

Examples of a solvent used for preparing the conductive layer coating liquid include ether-based solvents, alcohol-based solvents, ketone-based solvents, and aromatic hydrocarbon solvents. The thickness of the conductive layer is preferably 0.2 μm or more and 40 μm or less, more preferably 1 μm or more and 35 μm or less, and still more preferably 5 μm or more and 30 μm or less.

Photosensitive Layer

A photosensitive layer is provided on the undercoat layer.

Examples of the charge generating substance include azo pigments, perylene pigments, anthraquinone derivatives, anthanthrone derivatives, dibenzpyrenequinone derivatives, pyranthrone derivatives, violanthrone derivatives, isoviolanthrone derivatives, indigo derivatives, thioindigo derivatives, phthalocyanine pigments such as metal phthalocyanine and metal-free phthalocyanine, and bisbenzimidazole derivatives. Among these charge generating substances, azo pigments and phthalocyanine pigments are preferable. Among phthalocyanine pigments, oxytitanium phthalocyanine, chlorogallium phthalocyanine, and hydroxygallium phthalocyanine are preferable.

In the case where the photosensitive layer is a layered-type photosensitive layer, examples of a binder resin used in the charge generating layer include polymers and copolymers of vinyl compounds such as styrene, vinyl acetate, vinyl chloride, acrylates, methacrylates, vinylidene fluoride, and trifluoroethylene, polyvinyl alcohol resins, polyvinyl acetal resins, polycarbonate resins, polyester resins, polysulfone resins, polyphenylene oxide resins, polyurethane resins, cellulose resins, phenolic resins, melamine resins, silicon resins, and epoxy resins. Among these binder resins, polyester resins, polycarbonate resins, and polyvinyl acetal resins are preferable, and polyvinyl acetal resins are more preferable.

The mass ratio of the charge generating substance to the binder resin in the charge generating layer (charge generating substance/binder resin) is preferably in the range of 10/1 to 1/10 and more preferably in the range of 5/1 to 1/5. The thickness of the charge generating layer is preferably 0.05 μm or more and 5 μm or less. Examples of a solvent used for preparing a charge generating layer coating liquid include alcohol-based solvents, sulfoxide-based solvents, ketone-based solvents, ether-based solvents, ester-based solvents, and aromatic hydrocarbon solvents.

Examples of the hole transporting substance include polycyclic aromatic compounds, heterocyclic compounds, hydrazone compounds, styryl compounds, benzidine compounds, triarylamine compounds, and triphenylamine. Examples of the hole transporting substance further include polymers that have a main chain or side chain having a group derived from any of these compounds.

Examples of a binder resin used in the hole transporting layer include polyester resins, polycarbonate resins, polymethacrylate resins, polyarylate resins, polysulfone resins, and polystyrene resins. Among these binder resins, polycarbonate resins and polyarylate resins are preferable. The weight-average molecular weight of the binder resin is preferably in the range of 10,000 to 300,000.

The ratio of the hole transporting substance to the binder resin in the hole transporting layer (hole transporting substance/binder resin) is preferably in the range of 10/5 to 5/10 and more preferably in the range of 10/8 to 6/10. The thickness of the hole transporting layer is preferably 5 μm or more and 40 μm or less.

Examples of a solvent used for preparing a hole transporting layer coating liquid include alcohol-based solvents, sulfoxide-based solvents, ketone-based solvents, ether-based solvents, ester-based solvents, and aromatic hydrocarbon solvents.

A protective layer (surface protecting layer) that contains conductive particles or a hole transporting substance and a binder resin may be provided on the photosensitive layer (hole transporting layer). The protective layer may further contain additives such as a lubricant. Electrical conductivity or a hole transporting property may be imparted to the binder resin of the protective layer. In such a case, conductive particles or a hole transporting substance other than the resin need not be incorporated in the protective layer. The binder resin in the protective layer may be a thermoplastic resin or a curable resin that is curable with heat, light, or radiation (such as an electron beam).

The layers that constitute the electrophotographic photosensitive member may be formed by dissolving and/or dispersing materials constituting the respective layers in respective solvents to prepare coating liquids, applying the coating liquids, and drying and/or curing the resulting coats. Examples of the method for applying the coating liquids include a dip coating method (dip application method), a spray coating method, a curtain coating method, a spin coating method, and a ring method. Among these methods, a dip coating method is preferable from the standpoints of efficiency and productivity.

Process Cartridge and Electrophotographic Apparatus

FIG. 1 illustrates an example of a schematic structure of an electrophotographic apparatus that includes a process cartridge including an electrophotographic photosensitive member according to an embodiment of the present invention.

Referring to FIG. 1, a cylindrical electrophotographic photosensitive member 1 is rotated around a shaft 2 in the direction shown by the arrow at a particular peripheral speed. The surface (peripheral surface) of the electrophotographic photosensitive member 1 rotated is uniformly charged to a particular positive or negative potential with a charging device 3 (primary charging device: charging roller or the like). Subsequently, the surface receives exposure light (image exposure light) 4 from an exposure device (not shown) using slit exposure, laser beam scanning exposure, or the like. Thus, an electrostatic latent image corresponding to a desired image is sequentially formed on the surface of the electrophotographic photosensitive member 1.

The electrostatic latent image formed on the surface of the electrophotographic photosensitive member 1 is then developed with a toner contained in a developer in a developing device 5 and becomes a toner image. The toner image carried on the surface of the electrophotographic photosensitive member 1 is then sequentially transferred to a transfer material (such as paper) P by a transfer bias from a transferring device (such as transfer roller) 6. The transfer material P is taken out from a transfer material feeding unit (not shown) and fed to a nip portion (contact portion) between the electrophotographic photosensitive member 1 and the transferring device 6 in synchronization with the rotation of the electrophotographic photosensitive member 1.

The transfer material P that has received the transfer of the toner image is detached from the surface of the electrophotographic photosensitive member 1 and guided to a fixing device 8 in which the image is fixed. Thus, an image product (print or a copy) is discharged from the apparatus.

The surface of the electrophotographic photosensitive member 1 after the transfer of the toner image is cleaned with a cleaning device (such as a cleaning blade) 7 by removing the developer (toner) that remains after the transfer. Subsequently, the charge is erased with pre-exposure light (not shown) emitted from a pre-exposure device (not shown), and the electrophotographic photosensitive member 1 is then repeatedly used for forming images. When the charging device 3 is a contact-type charging device such as a charging roller as illustrated in FIG. 1, the pre-exposure light is not necessarily provided.

A plurality of components selected from the electrophotographic photosensitive member 1, the charging device 3, the developing device 5, the transferring device 6, the cleaning device 7, etc., may be integrally housed in a container to constitute a process cartridge. The process cartridge may be detachably attached to a main body of an electrophotographic apparatus such as a copy machine or a laser beam printer. In FIG. 1, the electrophotographic photosensitive member 1, the charging device 3, the developing device 5, and the cleaning device 7 are integrally supported to form a process cartridge 9. The process cartridge 9 is detachably attached to the main body of the electrophotographic apparatus using a guiding unit 10 such as a rail of the main body of the electrophotographic apparatus.

EXAMPLES

The present invention will now be described in more detail by way of Examples, but the present invention is not limited to these Examples. Note that, in the description of Examples below, the term "parts" means "parts by mass".

Example 1

An aluminum cylinder having a length of 260.5 mm and a diameter of 30 mm (JIS-A3003, aluminum alloy) was used as a support (conductive support).

Next, 50 parts of titanium oxide particles (powder resistivity: 120 Ω·cm, coverage of tin oxide: 40% by mass) coated with oxygen-deficient tin oxide, 40 parts of a phenolic resin (trade name: PLYOPHEN J-325, manufactured by DIC Corporation, resin solid content: 60%), and 50 parts of methoxypropanol serving as a solvent (dispersion medium) were placed in a sand mill containing glass beads having a diameter of 0.8 mm, and a dispersion treatment was conducted for three hours to prepare a dispersion liquid. After the dispersion treatment, 0.01 parts of silicone oil SH28PA (manufactured by Dow Corning Toray Silicone Co., Ltd.) and silicone fine particles (Tospearl 120CA) serving as organic resin particles were added to the dispersion liquid, and the resulting dispersion liquid was stirred to prepare a conductive layer coating liquid. The silicone fine particles were added so that the content of the silicone fine particles was 5% by mass relative to the solid content (the total mass of the titanium oxide particles and the phenolic resin). The conductive layer coating liquid was applied onto the support by dip coating and the resulting coat was dried and thermally polymerized at 150° C. for 30 minutes. As a result, a conductive layer having a thickness of 16 μm was formed.

An average particle size of the titanium oxide particles coated with oxygen-deficient tin oxide in the conductive layer coating liquid was measured with a particle size distribution analyzer (trade name: CAPA700) manufactured by Horiba, Ltd. The measurement was conducted by a centrifugal sedimentation method using tetrahydrofuran as a dispersion medium at a speed of rotation of 5,000 rpm. According to the result, the average particle size was 0.33 μm.

Next, 10 parts of the electron transporting compound (A1-1), 0.15 parts of zinc(II) octylate, 23 parts of a blocked isocyanate compound serving as a cross-linking agent and represented by formula (1) below, and 3 parts of a butyral resin (trade name: S-LEC BX-1, manufactured by Sekisui Chemical Co., Ltd.) were dissolved in a mixed solvent containing 250 parts of tetrahydrofuran and 250 parts of cyclohexanone to prepare an undercoat layer coating liquid. The undercoat layer coating liquid was applied onto the conductive layer by dip coating. The resulting coat was dried and cured by being heated at 160° C. for 30 minutes. As a result, an undercoat layer which was a cured layer having a thickness of 0.7 μm was formed. After the completion of evaluation described below, the content of zinc(II) octylate in this undercoat layer was measured by the measuring method described above. The content of zinc(II) octylate was 0.54% by mass.

(1)

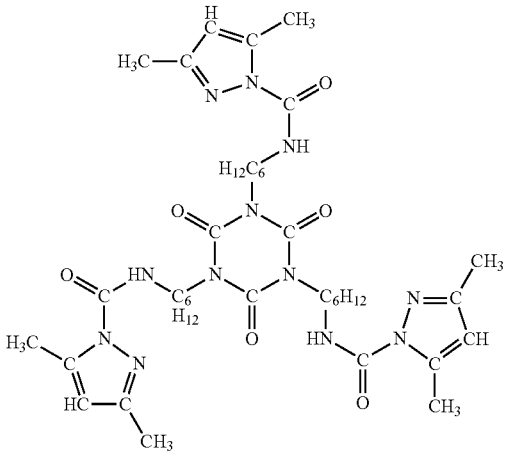

Next, 10 parts of hydroxygallium phthalocyanine crystals (charge generating substance) that have intense peaks at Bragg angles (2θ±0.2° of 7.5°, 9.9°, 12.5°, 16.3°, 18.6°, 25.1°, and 28.3° in CuKα characteristic X-ray diffraction, 5 parts of a butyral resin (trade name: S-LEC BX-1, manufactured by Sekisui Chemical Co., Ltd., and 260 parts of cyclohexanone were placed in a sand mill containing glass beads having a diameter of 1 mm, and a dispersion treatment was conducted for 1.5 hours. Next, 240 parts of ethyl acetate was added to the resulting dispersion liquid to prepare a charge generating layer coating liquid. The charge generating layer coating liquid was applied onto the undercoat layer by dip coating and the resulting coat was dried at 95° C. for ten minutes to form a charge generating layer having a thickness of 0.18 μm.

Next, 10 parts of a polyarylate resin C (including a structural unit represented by formula (3-1) below and a structural unit represented by formula (3-2) below at a ratio of 5/5 and having a weight-average molecular weight of 100,000) and 7 parts of an amine compound (hole transporting substance) represented by formula (2) below were dissolved in a mixed solvent containing 30 parts of dimethoxymethane and 70 parts of chlorobenzene to prepare a charge transporting layer coating liquid. The charge transporting layer coating liquid was applied onto the charge generating layer by dip coating and the resulting coat was dried at 120° C. for 60 minutes. As a result, a charge transporting layer having a thickness of 15 μm was formed.

(2)

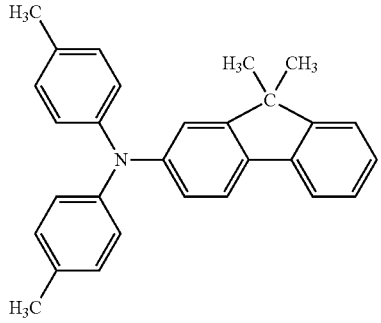

(3-1)

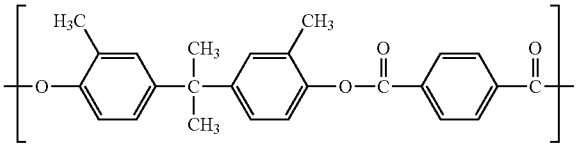

(3-2)

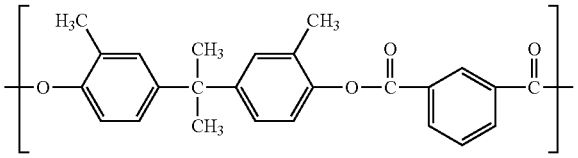

An electrophotographic photosensitive member including a conductive layer, an undercoat layer, a charge generating layer, and a charge transporting layer that were formed on a support in that order was prepared as described above.

Evaluation of Positive Ghosting

The electrophotographic photosensitive member prepared was installed in a modified laser beam printer (trade name: LBP-2510) manufactured by CANON KABUSHIKI KAISHA in an environment at a temperature of 15° C. and at a humidity of 10% RH. The surface potential was measured, and an output image was evaluated. The details are described below.

The measurement for evaluation of the surface potential was conducted as follows. A cyan process cartridge of the laser beam printer was modified, and a potential probe (model 6000B-8: manufactured by TREK Japan K.K.) was attached at a developing position. The potential of a central portion of the electrophotographic photosensitive member was measured by using a surface potential meter (model 344: manufactured by TREK Japan K.K.). Regarding the surface potential of a drum, the amount of light of image exposure was set so that an initial dark-area potential (Vd) was −500 V and an initial light-area potential (Vl) was −100 V.

Subsequently, the electrophotographic photosensitive member prepared was installed in a cyan process cartridge of the laser beam printer. The process cartridge was installed in a cyan process cartridge station and images were output. Subsequently, one sheet with a solid white image, five sheets with images for ghosting evaluation, one sheet with a solid black image, and five sheets with images for ghosting evaluation were continuously output in that order.

Figure 2:
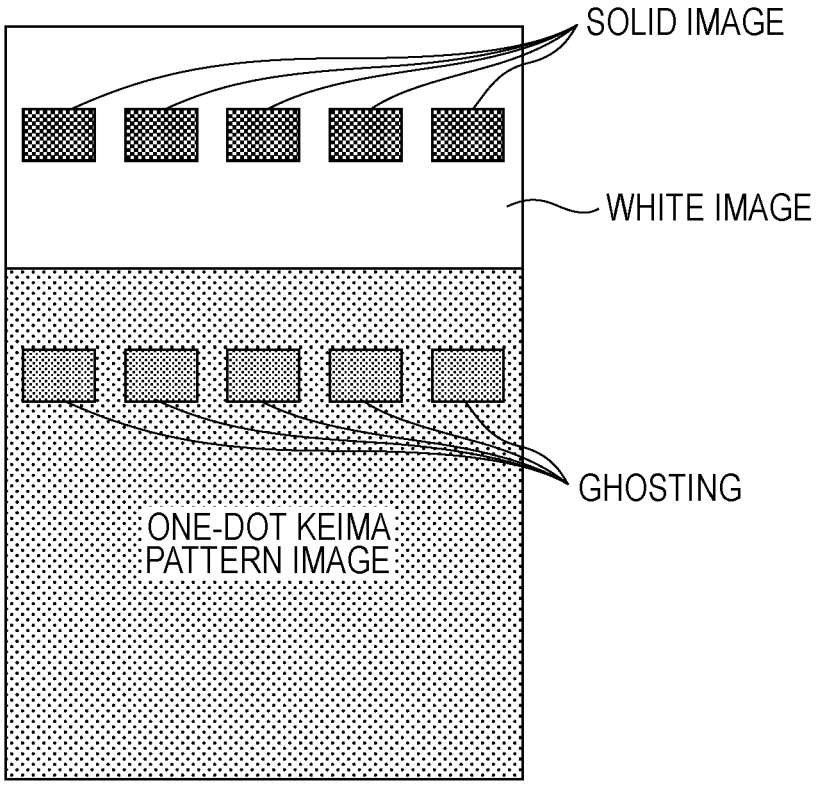
FIG. 2 is a view illustrating an image for ghosting evaluation used when a ghosting image evaluation is conducted.
Figure 3:
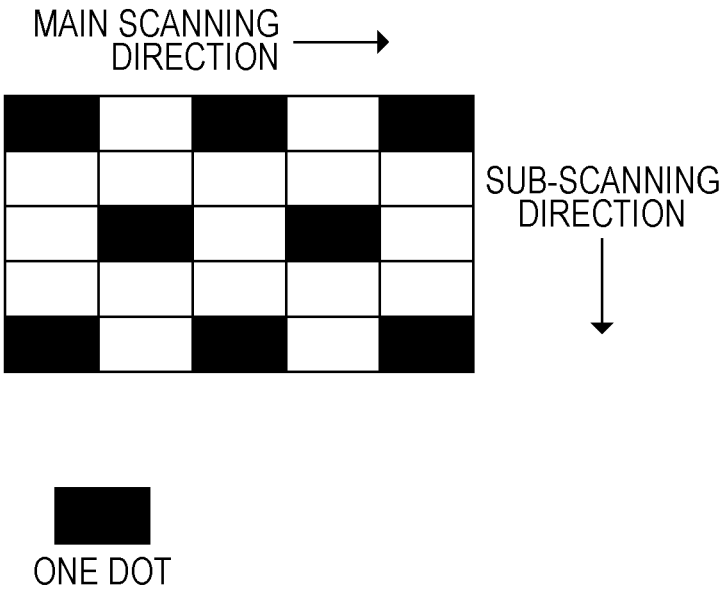
FIG. 3 is a view illustrating a one-dot Keima pattern image.

The image for ghosting evaluation was formed as follows. As illustrated in FIG. 2, quadrangular "solid images" were output in a "white image" of an upper portion of an image and a "half-tone image of a one-dot Keima pattern (i.e., spaced checkerboard pattern)" illustrated in FIG. 3 was then formed in a lower portion. The portions marked as "ghosting" (ghosting portions) in FIG. 2 are portions where ghosting due to the "solid images" can occur.

The positive ghosting was evaluated by measuring a density difference between the image density of the half-tone image of the one-dot Keima pattern and the image density of a ghosting portion. The density difference was measured at ten points in one sheet of the image for ghosting evaluation by using a spectro-densitometer (trade name: X-Rite 504/508, manufactured by X-Rite Inc.). This operation was conducted on all of the ten sheets of the images for ghosting evaluation. The average of the results of the total of 100 points was calculated to evaluate a Macbeth density difference at the time when initial images were output. The results are shown in Table 10.

The higher the density of the ghosting portion, the more significantly positive ghosting occurs. The smaller the Macbeth density difference, the more the positive ghosting is suppressed (reduced). A Macbeth density difference of 0.05 or more was a level at which an obvious difference was visually observed. A Macbeth density difference of less than 0.05 was a level at which no obvious difference was visually observed.

Examples 2 to 31

Electrophotographic photosensitive members were prepared as in Example 1 except that the electron transporting compound and the metal salt of organic acid used in Example 1 were changed to electron transporting compounds and metal salts of organic acids shown in Table 10. The evaluation of positive ghosting was conducted as in Example 1. The results are shown in Table 10.

Examples 32 and 33

Electrophotographic photosensitive members were prepared as in Example 1 except that the amount (parts by mass) of zinc(II) octylate used in Example 1 was changed from 0.15 parts to 0.07 parts (Example 32) or 0.30 parts (Example 33). The evaluation of positive ghosting was conducted as in Example 1. The results are shown in Table 10.

Examples 34 to 36

Electrophotographic photosensitive members were prepared as in Example 21 except that the amount (parts by mass) of cobalt(II) octylate used in Example 21 was changed from 0.15 parts to 0.02 parts (Example 34), 0.04 parts (Example 35), or 0.07 parts (Example 36). The evaluation of positive ghosting was conducted as in Example 21. The results are shown in Table 10.

Examples 37 to 39

Electrophotographic photosensitive members were prepared as in Example 7 except that 0.15 parts of zinc(II) octylate used in Example 7 was changed to 0.075 parts of zinc(II) octylate and 0.075 parts of nickel(II) octylate (Example 37), 0.075 parts of zinc(II) octylate and 0.075 parts of copper(II) octylate (Example 38), or 0.075 parts of zinc(II) butyrate and 0.075 parts of zinc(II) hexanoate (Example 39). The evaluation of positive ghosting was conducted as in Example 7. The results are shown in Table 10.

Examples 40 to 45

Electrophotographic photosensitive members were prepared as in Example 7 except that the amount (parts by mass) of zinc(II) octylate used in Example 7 was changed from 0.15 parts to 0.02 parts (Example 40), 0.04 parts (Example 41), 0.07 parts (Example 42), 0.30 parts (Example 43), 1.5 parts (Example 44), or 3.0 parts (Example 45). The evaluation of positive ghosting was conducted as in Example 7. The results are shown in Table 10.

Example 46

An electrophotographic photosensitive member was prepared as in Example 1 except that the undercoat layer was formed as described below, and the evaluation of positive ghosting was conducted as in Example 1. The results are shown in Table 10.

Specifically, 12 parts of the electron transporting compound (A1-1), 0.14 parts of zinc(II) octylate, 11 parts of a butyl-etherified melamine compound serving as a cross-linking agent and represented by formula (4) below, and 10 parts of an alkyd resin (trade name: M-6405-50, manufactured by DIC Corporation) were dissolved in a mixed solvent containing 230 parts of tetrahydrofuran and 230 parts of cyclohexanone to prepare an undercoat layer coating liquid. The undercoat layer coating liquid was applied onto a conductive layer by dip coating. The resulting coat was cured by being heated at 160° C. for 30 minutes. As a result, an undercoat layer which was a cured layer having a thickness of 0.7 μm was formed. After the completion of the evaluation described above, the content of zinc(II) octylate in the undercoat layer was measured by the measuring method described above. The content of zinc(II) octylate was 0.52% by mass.

(4)

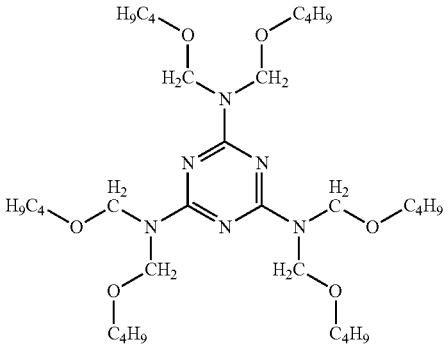

Examples 47 to 61

Electrophotographic photosensitive members were prepared as in Example 46 except that the electron transporting compound and the metal salt of organic acid used in Example 46 were changed to electron transporting compounds and metal salts of organic acids shown in Tables 10 and 11. The evaluation of positive ghosting was conducted as in Example 46. The results are shown in Tables 10 and 11.

Example 62

An electrophotographic photosensitive member was prepared as in Example 1 except that the undercoat layer was formed as described below, and the evaluation of positive ghosting was conducted as in Example 1. The results are shown in Table 11.

Specifically, 9 parts of the electron transporting compound (A1-1), 0.13 parts of zinc(II) octylate, and 25 parts of the blocked isocyanate compound serving as a cross-linking agent and represented by formula (1) above were dissolved in a mixed solvent containing 240 parts of tetrahydrofuran and 240 parts of cyclohexanone to prepare an undercoat layer coating liquid. The undercoat layer coating liquid was applied onto a conductive layer by dip coating. The resulting coat was cured by being heated at 160° C. for 30 minutes. As a result, an undercoat layer which was a cured layer having a thickness of 0.7 μm was formed.

Example 63

An electrophotographic photosensitive member was prepared as in Example 1 except that the undercoat layer was formed as described below, and the evaluation of positive ghosting was conducted as in Example 1. The results are shown in Table 11.

A polymer (cured product) of an electron transporting compound was obtained by a method described below.

To a 100-mL three-necked flask, 1 g of the electron transporting compound (A1-11) and 10 g of N,N-dimethylacetamide were added while dry nitrogen gas was fed. The mixture was vigorously stirred at 25° C. and 5 mg of azobisisobutyronitrile (AIBN) serving as a polymerization initiator was added to the mixture. A polymerization reaction was conducted at 65° C. for 50 hours while nitrogen was fed. After the completion of the reaction, the reaction mixture was added dropwise to 500 mL of methanol while being vigorously stirred. The resulting precipitate was collected by filtration. The precipitate was dissolved in 10 g of N,N-dimethylacetamide, and the resulting solution was filtered. The filtrate was then added dropwise to 500 mL of methanol to precipitate a polymer. The precipitated polymer was collected by filtration. The polymer was dispersed and washed with 1 L of methanol, and then dried. As a result, 0.89 g of a polymer was obtained. A molecular weight of the obtained polymer was measured by gel permeation chromatography (GPC) (chloroform mobile phase). The polymer had a weight-average molecular weight of 84,000.

A undercoat layer coating liquid containing 6 parts of the polymer of the electron transporting compound, 0.03 parts of zinc(II) octylate, 10 parts of chlorobenzene, and 90 parts of tetrahydrofuran was prepared. The undercoat layer coating liquid was applied onto a conductive layer by dip coating. The resulting coat was cured by being heated at 120° C. for 30 minutes. As a result, an undercoat layer which was a cured layer having a thickness of 0.7 μm was formed.

Example 64

An electrophotographic photosensitive member was prepared as in Example 1 except that the conductive layer, the undercoat layer, and the charge transporting layer were formed as described below, and the evaluation of positive ghosting was conducted as in Example 1. The results are shown in Table 11.

In a sand mill containing 450 parts of glass beads having a diameter of 0.8 mm, 214 parts of titanium oxide particles coated with oxygen-deficient tin oxide, 132 parts of a phenolic resin (trade name: PLYOPHEN J-325, manufactured by DIC Corporation, resin solid content: 60% by mass), and 98 parts of 1-methoxy-2-propanol serving as a solvent were placed, and a dispersion treatment was conducted at a speed of rotation of 2,000 rpm for a dispersion treatment time of 4.5 hours at a cooling water preset temperature of 18° C. to prepare a dispersion liquid. After the dispersion treatment, the glass beads were removed from the dispersion liquid by using a mesh (opening: 150 μm). Subsequently, silicone resin particles (trade name: Tospearl 120) were added to the dispersion liquid so that the content of the silicone resin particles was 10% by mass relative to the total mass of the metal oxide particles and the binder resin in the dispersion liquid obtained after the removal of the glass beads. In addition, silicone oil (SH28PA) serving as a leveling agent was added to the dispersion liquid so that the content of the silicone oil was 0.01% by mass relative to the total mass of the metal oxide particles and the binder resin in the dispersion liquid. The resulting dispersion liquid was stirred to prepare a conductive layer coating liquid. The conductive layer coating liquid was applied onto a support by dip coating and the resulting coat was dried and thermally cured at 150° C. for 30 minutes. As a result, a conductive layer having a thickness of 30 μm was formed.

Next, 10 parts of the electron transporting compound (A1-13), 0.15 parts of zinc(II) octylate, 23 parts of the blocked isocyanate compound represented by formula (1) above, and 3 parts of an acetal resin (trade name: S-LEC KS-5, manufactured by Sekisui Chemical Co., Ltd.) were dissolved in a mixed solvent containing 250 parts of tetrahydrofuran and 250 parts of cyclohexanone to prepare an undercoat layer coating liquid. The undercoat layer coating liquid was applied onto the conductive layer by dip coating. The resulting coat was dried and cured by being heated at 160° C. for 30 minutes. As a result, an undercoat layer which was a cured layer having a thickness of 0.7 μm was formed. After the completion of the evaluation described above, the content of zinc(II) octylate in this undercoat layer was measured by the measuring method described above. The content of zinc(II) octylate was 0.54% by mass.

Next, 9 parts of the amine compound represented by formula (2) above, 1 part of an amine compound represented by formula (8) below, 10 parts of a polycarbonate resin A, and 0.3 parts of a polycarbonate resin B (having a weight-average molecular weight of 40,000) were dissolved in a mixed solvent containing 30 parts of dimethoxymethane and 50 parts of ortho-xylene to prepare a charge transporting layer coating liquid. The polycarbonate resin A includes a structural unit represented by formula (9-1) below and has a weight-average molecular weight of 70,000. The polycarbonate resin B includes the structural unit represented by formula (9-1) below, a structural unit represented by formula (9-2) below, and a structure represented by formula (9-3) below in at least one of the terminals. The total content of the structures represented by formulae (9-2) and (9-3) is 30% by mass relative to the total mass of the polycarbonate resin B.

The charge transporting layer coating liquid was applied onto a charge generating layer by dip coating and the resulting coat was dried at 120° C. for 60 minutes. As a result, a charge transporting layer having a thickness of 16 μm was formed.

(8)

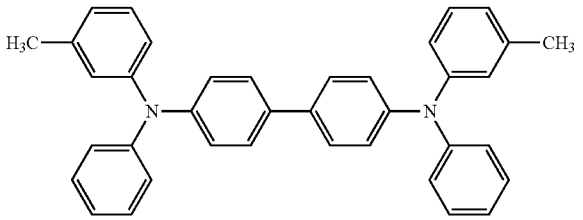

-continued (9-1)

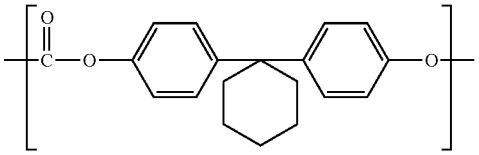

(9-2)

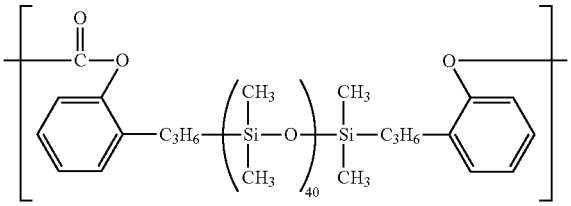

(9-3)

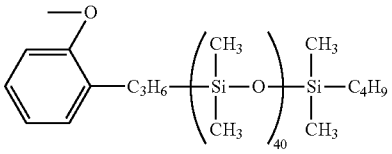

Example 65

An electrophotographic photosensitive member was prepared as in Example 64 except that the polycarbonate resin A used in Example 64 was changed to a polyarylate resin C, and the evaluation of positive ghosting was conducted as in Example 64. The results are shown in Table 11. The polyarylate resin C includes the structural unit represented by formula (3-1) above and the structural unit represented by formula (3-2) above at a ratio of 5/5 and has a weight-average molecular weight of 120,000.

Example 66

An electrophotographic photosensitive member was prepared as in Example 64 except that the charge transporting layer was formed as described below, and the evaluation of positive ghosting was conducted as in Example 64. The results are shown in Table 11.

Next, 9 parts of the amine compound represented by formula (2) above, 1 part of the amine compound represented by formula (8) above, 3 parts of a polyester resin D, and 7 parts of a polyarylate resin C were dissolved in a mixed solvent containing 30 parts of dimethoxymethane and 50 parts of ortho-xylene to prepare a charge transporting layer coating liquid. The polyester resin D includes a structural unit represented by formula (7-1) below, a structural unit represented by formula (7-2) below, and a structural unit represented by formula (7-3) below at a (7-2)/(7-3) ratio of 3/7. The content of the structural unit represented by formula (7-1) is 10% by mass relative to the total mass of the polyester resin D. The content of the structural unit represented by formula (7-2) and the structural unit represented by formula (7-3) is 90% by mass relative to the total mass of the polyester resin D.

The charge transporting layer coating liquid was applied onto a charge generating layer by dip coating and the resulting coat was dried at 120° C. for 60 minutes. As a result, a charge transporting layer having a thickness of 16 μm was formed. It was confirmed that the formed charge transporting layer included a domain structure containing the polyester resin D in a matrix that contained the hole transporting substance and the polyarylate resin.

(7-1)

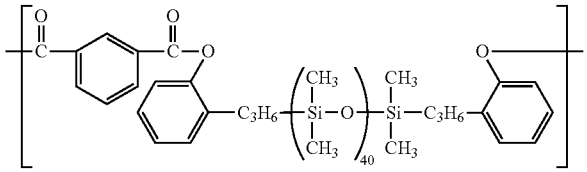

(7-2)

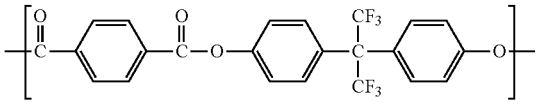

(7-3)

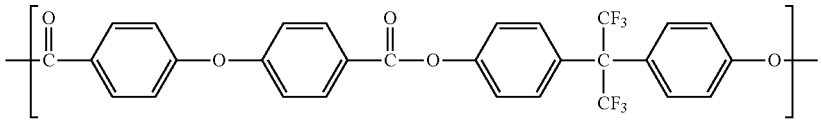

Example 67

An electrophotographic photosensitive member was prepared as in Example 64 except that the electron transporting compound (A1-13) used in Example 64 was changed to the electron transporting compound (A1-14), and the evaluation of positive ghosting was conducted as in Example 64. The results are shown in Table 11.

Examples 68 to 71

Electrophotographic photosensitive members were prepared as in Examples 64 to 67 except that the conductive layer was formed as described below, and the evaluation of positive ghosting was conducted as in Examples 64 to 67. The results are shown in Table 11.

In a sand mill containing 450 parts of glass beads having a diameter of 0.8 mm, 207 parts of titanium oxide particles coated with phosphorus-doped tin oxide and serving as metal oxide particles, 144 parts of a phenolic resin (PLYOPHEN J-325), and 98 parts of 1-methoxy-2-propanol were placed, and a dispersion treatment was conducted at a speed of rotation of 2,000 rpm for a dispersion treatment time of 4.5 hours at a cooling water preset temperature of 18° C. to prepare a dispersion liquid. After the dispersion treatment, the glass beads were removed from the dispersion liquid by using a mesh (opening: 150 μm). Subsequently, silicone resin particles (Tospearl 120) were added to the dispersion liquid so that the content of the silicone resin particles was 15% by mass relative to the total mass of the metal oxide particles and the binder resin in the dispersion liquid obtained after the removal of the glass beads. In addition, silicone oil (SH28PA) was added to the dispersion liquid so that the content of the silicone oil was 0.01% by mass relative to the total mass of the metal oxide particles and the binder resin in the dispersion liquid. The resulting dispersion liquid was stirred to prepare a conductive layer coating liquid. The conductive layer coating liquid was applied onto a support by dip coating and the resulting coat was dried and thermally cured at 150° C. for 30 minutes. As a result, a conductive layer having a thickness of 30 μm was formed.

Comparative Examples 1 to 3

Electrophotographic photosensitive members were prepared as in Example 1 except that the electron transporting compound and the metal salt of organic acid used in Example 1 were changed to an electron transporting compound and organometallic compounds shown in Table 11, and the evaluation of positive ghosting was conducted as in Example 1. The results are shown in Table 11.

Comparative Example 4

An electrophotographic photosensitive member was prepared as in Example 1 except that the undercoat layer was formed as described below, and the evaluation of positive ghosting was conducted as in Example 1. The results are shown in Table 11.

Specifically, 5 parts of the electron transporting compound (A7-2) and 3 parts of a butyral resin (S-LEC BX-1) were dissolved in 10 parts of toluene. Next, 40 parts of a toluene 50 mass % solution of zirconium tetrabutyrate was added dropwise to the solution, and mixed under stirring. The resulting mixture was filtered to prepare an undercoat layer coating liquid. The undercoat layer coating liquid was applied onto a conductive layer by ring coating. The resulting coat was air-dried at room temperature for five minutes and then heated at 170° C. for ten minutes. As a result, an undercoat layer having a thickness of 1.0 μm was formed.

Comparative Example 5

An electrophotographic photosensitive member was prepared as in Example 62 except that zinc(II) octylate used in Example 62 was changed to dioctyltin dilaurate, and the evaluation of positive ghosting was conducted as in Example 62. The results are shown in Table 11.

Comparative Example 6

An electrophotographic photosensitive member was prepared as in Example 63 except that zinc(II) octylate was not incorporated, and the evaluation of positive ghosting was conducted as in Example 63. The results are shown in Table 11.

TABLE 10

| Example | Electron transporting compound | Cross-linking agent | Resin | Metal salt of organic acid Type | Metal salt of organic acid Content | Macbeth density difference |
|---|---|---|---|---|---|---|
| 1 | A1-1 | Formula (1) | Butyral resin | Zinc(II) octylate | 0.54% | 0.030 |
| 2 | A1-1 | Formula (1) | Butyral resin | Zinc(II) butyrate | 0.54% | 0.029 |
| 3 | A1-1 | Formula (1) | Butyral resin | Zinc(II) hexanoate | 0.54% | 0.029 |
| 4 | A1-1 | Formula (1) | Butyral resin | Zinc(II) octanoate | 0.54% | 0.030 |
| 5 | A1-1 | Formula (1) | Butyral resin | Nickel(II) octylate | 0.54% | 0.030 |
| 6 | A1-1 | Formula (1) | Butyral resin | Nickel(II) octanoate | 0.54% | 0.030 |
| 7 | A1-4 | Formula (1) | Butyral resin | Zinc(II) octylate | 0.54% | 0.032 |
| 8 | A1-4 | Formula (1) | Butyral resin | Zinc(II) octylate | 0.54% | 0.032 |
| 9 | A2-5 | Formula (1) | Butyral resin | Zinc(II) hexanoate | 0.54% | 0.043 |
| 10 | A3-3 | Formula (1) | Butyral resin | Zinc(II) hexanoate | 0.54% | 0.043 |
| 11 | A4-3 | Formula (1) | Butyral resin | Zinc(II) hexanoate | 0.54% | 0.042 |
| 12 | A5-4 | Formula (1) | Butyral resin | Zinc(II) hexanoate | 0.54% | 0.042 |
| 13 | A6-1 | Formula (1) | Butyral resin | Zinc(II) hexanoate | 0.54% | 0.042 |
| 14 | A7-5 | Formula (1) | Butyral resin | Zinc(II) hexanoate | 0.54% | 0.042 |
| 15 | A8-1 | Formula (1) | Butyral resin | Zinc(II) hexanoate | 0.54% | 0.042 |
| 16 | A9-2 | Formula (1) | Butyral resin | Zinc(II) hexanoate | 0.54% | 0.043 |
| 17 | A1-1 | Formula (1) | Butyral resin | Zinc(II) formate | 0.54% | 0.036 |
| 18 | A1-1 | Formula (1) | Butyral resin | Zinc(II) propionate | 0.54% | 0.032 |
| 19 | A1-1 | Formula (1) | Butyral resin | Zinc(II) laurate | 0.54% | 0.033 |
| 20 | A1-1 | Formula (1) | Butyral resin | Iron(III) octylate | 0.54% | 0.035 |
| 21 | A1-1 | Formula (1) | Butyral resin | Cobalt(II) octylate | 0.54% | 0.035 |
| 22 | A1-1 | Formula (1) | Butyral resin | Copper(II) octylate | 0.54% | 0.035 |
| 23 | A1-1 | Formula (1) | Butyral resin | Iron(III) naphthenate | 0.54% | 0.040 |
| 24 | A1-1 | Formula (1) | Butyral resin | Cobalt(II) naphthenate | 0.54% | 0.040 |
| 25 | A1-1 | Formula (1) | Butyral resin | Copper(II) naphthenate | 0.54% | 0.040 |
| 26 | A1-1 | Formula (1) | Butyral resin | Zinc(II) naphthenate | 0.54% | 0.037 |
| 27 | A1-1 | Formula (1) | Butyral resin | Zinc(II) benzoate | 0.54% | 0.039 |
| 28 | A1-1 | Formula (1) | Butyral resin | Zinc(II) oxalate | 0.54% | 0.042 |
| 29 | A1-1 | Formula (1) | Butyral resin | Zinc(II) citrate | 0.54% | 0.042 |
| 30 | A1-1 | Formula (1) | Butyral resin | Zinc(II) tartrate | 0.54% | 0.042 |
| 31 | A1-1 | Formula (1) | Butyral resin | Zinc(II) p-toluenesulfonate | 0.54% | 0.043 |
| 32 | A1-1 | Formula (1) | Butyral resin | Zinc(II) octylate | 0.25% | 0.030 |
| 33 | A1-1 | Formula (1) | Butyral resin | Zinc(II) octylate | 1.08% | 0.030 |
| 34 | A1-1 | Formula (1) | Butyral resin | Cobalt(II) octylate | 0.07% | 0.037 |

TABLE 10-continued

| Example | Electron transporting compound | Cross-linking agent | Resin | Metal salt of organic acid Type | Metal salt of organic acid Content | Macbeth density difference |
|---|---|---|---|---|---|---|
| 35 | A1-1 | Formula (1) | Butyral resin | Cobalt(II) octylate | 0.14% | 0.034 |
| 36 | A1-1 | Formula (1) | Butyral resin | Cobalt(II) octylate | 0.25% | 0.035 |
| 37 | A1-4 | Formula (1) | Butyral resin | Zinc(II) octylate<br>Nickel(II) octylate | 0.27%<br>0.27% | 0.032 |
| 38 | A1-4 | Formula (1) | Butyral resin | Zinc(II) octylate<br>Copper(II) octylate | 0.27%<br>0.27% | 0.034 |
| 39 | A1-4 | Formula (1) | Butyral resin | Zinc(II) butyrate<br>Zinc(II) hexanoate | 0.27%<br>0.27% | 0.032 |
| 40 | A1-4 | Formula (1) | Butyral resin | Zinc(II) octylate | 0.07% | 0.037 |
| 41 | A1-4 | Formula (1) | Butyral resin | Zinc(II) octylate | 0.14% | 0.033 |
| 42 | A1-4 | Formula (1) | Butyral resin | Zinc(II) octylate | 0.25% | 0.032 |
| 43 | A1-4 | Formula (1) | Butyral resin | Zinc(II) octylate | 1.08% | 0.032 |
| 44 | A1-4 | Formula (1) | Butyral resin | Zinc(II) octylate | 5.4% | 0.033 |
| 45 | A1-4 | Formula (1) | Butyral resin | Zinc(II) octylate | 10.8% | 0.035 |
| 46 | A1-1 | Formula (2) | Alkyd resin | Zinc(II) octylate | 0.52% | 0.030 |
| 47 | A1-1 | Formula (2) | Alkyd resin | Zinc(II) butyrate | 0.54% | 0.029 |
| 48 | A1-1 | Formula (2) | Alkyd resin | Zinc(II) hexanoate | 0.54% | 0.029 |
| 49 | A1-1 | Formula (2) | Alkyd resin | Zinc(II) octanoate | 0.54% | 0.030 |
| 50 | A1-1 | Formula (2) | Alkyd resin | Nickel(II) octylate | 0.54% | 0.030 |

TABLE 11

| | Electron transporting compound | Cross-linking agent | Resin | Metal salt of organic acid Type | Metal salt of organic acid Content | Macbeth density difference |
|---|---|---|---|---|---|---|
| Example | | | | | | |
| 51 | A1-1 | Formula (2) | Alkyd resin | Nickel(II) octanoate | 0.54% | 0.030 |
| 52 | A1-4 | Formula (2) | Alkyd resin | Zinc(II) octylate | 0.54% | 0.032 |
| 53 | A1-4 | Formula (2) | Alkyd resin | Nickel(II) octylate | 0.54% | 0.032 |
| 54 | A2-5 | Formula (2) | Alkyd resin | Nickel(II) octylate | 0.54% | 0.043 |
| 55 | A3-3 | Formula (2) | Alkyd resin | Nickel(II) octylate | 0.54% | 0.043 |
| 56 | A4-3 | Formula (2) | Alkyd resin | Nickel(II) octylate | 0.54% | 0.042 |
| 57 | A5-4 | Formula (2) | Alkyd resin | Nickel(II) octylate | 0.54% | 0.042 |
| 58 | A6-1 | Formula (2) | Alkyd resin | Nickel(II) octylate | 0.54% | 0.042 |
| 59 | A7-5 | Formula (2) | Alkyd resin | Nickel(II) octylate | 0.54% | 0.042 |
| 60 | A8-1 | Formula (2) | Alkyd resin | Nickel(II) octylate | 0.54% | 0.042 |
| 61 | A9-2 | Formula (2) | Alkyd resin | Nickel(II) octylate | 0.54% | 0.043 |
| 62 | A1-1 | Formula (1) | Not contained | Zinc(II) octylate | 0.52% | 0.043 |
| 63 | Polymer of A1-11 | Not contained | Not contained | Zinc(II) octylate | 0.50% | 0.046 |
| 64 | A1-13 | Formula (1) | Acetal resin | Zinc(II) octylate | 0.54% | 0.030 |
| 65 | A1-13 | Formula (1) | Acetal resin | Zinc(II) octylate | 0.54% | 0.030 |
| 66 | A1-13 | Formula (1) | Acetal resin | Zinc(II) octylate | 0.54% | 0.030 |
| 67 | A1-14 | Formula (1) | Acetal resin | Zinc(II) octylate | 0.54% | 0.030 |
| 68 | A1-13 | Formula (1) | Acetal resin | Zinc(II) octylate | 0.54% | 0.032 |
| 69 | A1-13 | Formula (1) | Acetal resin | Zinc(II) octylate | 0.54% | 0.032 |
| 70 | A1-13 | Formula (1) | Acetal resin | Zinc(II) octylate | 0.54% | 0.032 |
| 71 | A1-14 | Formula (1) | Acetal resin | Zinc(II) octylate | 0.54% | 0.032 |
| Comparative Example | | | | | | |
| 1 | A1-4 | Formula (1) | Butyral resin | Dioctyltin dilaurate | 0.54% | 0.054 |
| 2 | A1-4 | Formula (1) | Butyral resin | Aluminum ethylacetoacetate diisopropylate | 0.54% | 0.055 |
| 3 | A1-4 | Formula (1) | Butyral resin | Zirconium tetrabutyrate | 0.54% | 0.061 |
| 4 | A7-2 | Not contained | Butyral resin | Zirconium tetrabutyrate | 71.4% | 0.059 |
| 5 | A1-1 | Formula (1) | Not contained | Dioctyltin dilaurate | 0.52% | 0.060 |
| 6 | Polymer of A1-11 | Not contained | Not contained | Not contained | 0% | 0.062 |

Example 72

An electrophotographic photosensitive member was prepared as in Example 1 except that the undercoat layer was formed as described below, and the evaluation of positive ghosting was conducted as in Example 1. The results are shown in Table 12.

Specifically, 9 parts of the electron transporting compound (A1-8), 0.1 parts of zinc(II) octylate, and 11 parts of a polyamide resin (trade name: Toresin EF30T manufactured by Nagase ChemteX Corporation) were dissolved in a mixed solvent containing 200 parts of methanol and 200 parts of 1-butanol to prepare an undercoat layer coating liquid (electron transporting layer coating liquid). The undercoat layer coating liquid was applied onto a conductive layer by dip coating to form a coat. The coat was heated at 100° C. for ten minutes. As a result, an undercoat layer having a thickness of 0.7 μm was formed. The content of zinc(II) octylate in this undercoat layer measured by the measuring method described above is 0.50% by mass.

Example 73

An electrophotographic photosensitive member was prepared as in Example 1 except that the undercoat layer was formed as described below, and the evaluation of positive ghosting was conducted as in Example 1. The results are shown in Table 12.

Specifically, 10 parts of the electron transporting compound (A1-8), 0.15 parts of zinc(II) octylate, 23 parts of the blocked isocyanate compound serving as a cross-linking agent and represented by formula (1) above, and 3 parts of a butyral resin (trade name: S-LEC BX-1, manufactured by Sekisui Chemical Co., Ltd.) were dissolved in a mixed solvent containing 250 parts of tetrahydrofuran and 250 parts of cyclohexanone to prepare an undercoat layer coating liquid. The undercoat layer coating liquid (electron transporting layer coating liquid) was applied onto a conductive layer by dip coating to form a coat. The coat was heated at 160° C. for 30 minutes. As a result, an undercoat layer having a thickness of 0.7 μm was formed. The content of zinc(II) octylate in this undercoat layer measured by the measuring method described above is 0.54% by mass.

Example 74

An electrophotographic photosensitive member was prepared as in Example 1 except that the undercoat layer was formed as described below, and the evaluation of positive ghosting was conducted as in Example 1. The results are shown in Table 12.

A polyolefin resin dispersion liquid was prepared by a method described below.

A polyolefin resin (trade name: Bondine HX-8290, manufactured by Sumitomo Chemical Co., Ltd.), 90 parts of 2-propanol, and triethylamine, the amount of which was 1.2 equivalents relative to the carboxyl group of maleic anhydride in the resin, and 200 parts of distilled water were charged in a pressure-resistant, 1-L glass container that was equipped with a stirrer and a heater and that could be hermetically sealed, and stirring was conducted with a stirring blade at a speed of rotation of 300 rpm. As a result, no precipitate of resin particulate matter was observed at the bottom of the container, and it was confirmed that resin particles are in a floating state. Fifteen minutes later, while this state was maintained, a power supply of the heater was turned to the ON state so as to conduct heating. The temperature in the system was then maintained at 145° C. and the reaction mixture was further stirred for 60 minutes. Subsequently, the glass container was immersed in a water bath and cooled to room temperature (to a temperature of about 25° C.) while stirring was continued at a speed of rotation of 300 rpm. Next, the reaction mixture was heat-filtered (air pressure: 0.2 MPa) with a 300-mesh stainless filter (wire diameter: 0.035 mm, plain weave). As a result, a milky white, uniform, polyolefin resin aqueous dispersion liquid having a solid content of 20% by mass was obtained. The polyolefin resin had a structure of structural unit represented by formula (5-1)/structural unit represented by formula (5-2)/structural unit represented by formula (5-3)=80/2/18 (% by mass), where formulae (5-1), (5-2), and (5-3) are shown below.

Next, 20 parts of the electron transporting compound (A1-7), 0.4 parts of zinc(II) octylate, 50 parts of the prepared polyolefin resin dispersion liquid, 250 parts of 2-propanol, and 150 parts of distilled water were placed in a sand mill apparatus containing glass beads having a diameter of 1 mm, and treated for two hours. Next, the resulting mixture was diluted with 250 parts of 2-propanol to dissolve the electron transporting compound. Thus, an undercoat layer coating liquid was prepared. The undercoat layer coating liquid was applied onto a conductive layer by dip coating. The resulting coat was heated at 90° C. for 20 minutes. As a result, an undercoat layer having a thickness of 0.7 μm was formed. The content of zinc(II) octylate in this undercoat layer measured by the measuring method described above is 0.57% by mass.

(5-1)

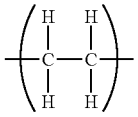

(5-2)

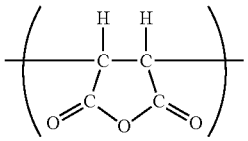

(5-3)

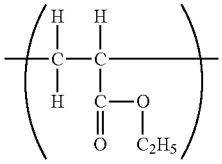

Comparative Example 7

An electrophotographic photosensitive member was prepared as in Example 72 except that zinc(II) octylate was not incorporated, and the evaluation of positive ghosting was conducted as in Example 72. The results are shown in Table 12.

Comparative Example 8

An electrophotographic photosensitive member was prepared as in Example 73 except that zinc(II) octylate used in Example 73 was changed to aluminum ethylacetoacetate diisopropylate, and the evaluation of positive ghosting was conducted as in Example 73. The results are shown in Table 12.

Comparative Example 9

An electrophotographic photosensitive member was prepared as in Example 74 except that zinc(II) octylate was not incorporated, and the evaluation of positive ghosting was conducted as in Example 74. The results are shown in Table 12.

TABLE 12

| | Electron transporting compound | Cross-linking agent | Resin | Metal salt of organic acid Type | Metal salt of organic acid Content | Macbeth density difference |
|---|---|---|---|---|---|---|
| Example | | | | | | |
| 72 | A1-8 | Not contained | Polyamide resin | Zinc(II) octylate | 0.50% | 0.045 |
| 73 | A1-8 | Formula (1) | Butyral resin | Zinc(II) octylate | 0.54% | 0.042 |
| 74 | A1-7 | Not contained | Polyolefin resin | Zinc(II) octylate | 0.57% | 0.044 |
| Comparative Example | | | | | | |
| 7 | A1-8 | Not contained | Polyamide resin | Not contained | 0% | 0.065 |
| 8 | A1-8 | Formula (1) | Butyral resin | Aluminum ethylacetoacetate diisopropylate | 0.54% | 0.062 |
| 9 | A1-7 | Not contained | Polyolefin resin | Not contained | 0% | 0.063 |

Example 75

An electrophotographic photosensitive member was prepared as in Example 1 except that the undercoat layer was formed as described below, and the evaluation of positive ghosting was conducted as in Example 1. The results are shown in Table 13.

A copolymer including a structural unit represented by formula (6-1) below and a structural unit represented jby formula (6-2) below was used as an electron transporting pigment. This copolymer had a ratio structural unit represented by formula (6-1)/structural unit represented by formula (6-2)=5/1 (molar ratio), and a weight-average molecular weight of 10,000. Next, 20 parts of the above electron transporting pigment, 0.01 parts of zinc(II) octylate, 150 parts of distilled water, 250 parts of methanol, and 4 parts of triethylamine were placed in a sand mill apparatus containing glass beads having a diameter of 1 mm, and a dispersion treatment was conducted for two hours to prepare an undercoat layer coating liquid. The undercoat layer coating liquid was applied onto a conductive layer by dip coating to form a coat. The coat was heated at 120° C. for 10 minutes to melt or aggregate, and dry the electron transporting pigment. As a result, an undercoat layer having a thickness of 0.7 μm was formed. The content of zinc(II) octylate in this undercoat layer measured by the measuring method described above is 0.50% by mass.

The particle sizes of the electron transporting pigment before and after the preparation of the undercoat layer coating liquid were measured with a particle size distribution analyzer (trade name: CAPA700) manufactured by Horiba, Ltd. The measurement was conducted by a centrifugal sedimentation method using methanol as a dispersion medium at a speed of rotation of 7,000 rpm. According to the results, the particle size before the preparation was 3.5 μm, and the particle size after the preparation was 0.3 μm.

(6-1)

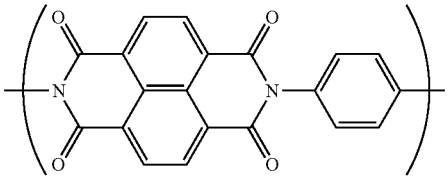

(6-2)

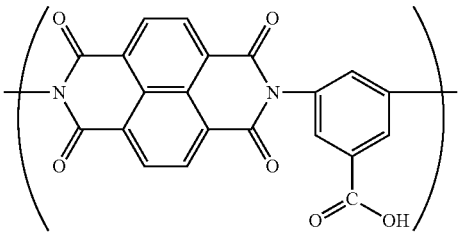

Comparative Example 10

An electrophotographic photosensitive member was prepared as in Example 75 except that zinc(II) octylate was not incorporated, and the evaluation of positive ghosting was conducted as in Example 75. The results are shown in Table 13.

TABLE 13

| | Electron transporting compound | Cross-linking agent | Resin | Metal salt of organic acid Type | Metal salt of organic acid Content | Macbeth density difference |
|---|---|---|---|---|---|---|
| Example | | | | | | |
| 75 | Formulae (6-1) and (6-2) | Not contained | Not contained | Zinc(II) octylate | 0.50% | 0.047 |
| Comparative Example | | | | | | |
| 10 | Formulae (6-1) and (6-2) | Not contained | Not contained | Not contained | 0% | 0.066 |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-263255 filed Nov. 30, 2012, No. 2013-030118 filed Feb. 19, 2013, and No. 2013-152791 filed Jul. 23, 2013, which are hereby incorporated by reference herein in their entirety.

What is claimed is:

1. An electrophotographic photosensitive member comprising:

a support;

an undercoat layer formed on the support; and a photosensitive layer formed on the undercoat layer, wherein the undercoat layer is an electron transporting layer, the undercoat layer comprises a metal salt of organic acid having at least one metal element selected from the group consisting of Fe, Co, Ni, Cu, and Zn, and (i) the undercoat layer is obtained by curing an electron transporting compound having a polymerizable functional group, or a composition containing an electron transporting compound having a polymerizable functional group, or (ii) the undercoat layer further comprises an electron transporting compound.

2. The electrophotographic photosensitive member according to claim 1, wherein the organic acid of the metal salt of organic acid is a monovalent carboxylic acid.

3. The electrophotographic photosensitive member according to claim 2, wherein the monovalent carboxylic acid is a fatty acid.

4. The electrophotographic photosensitive member according to claim 3, wherein the fatty acid has 4 to 8 carbon atoms.

5. The electrophotographic photosensitive member according to claim 1, wherein the metal salt of organic acid has at least one metal element selected from the group consisting of Ni and Zn.

6. The electrophotographic photosensitive member according to claim 1, wherein the content of the metal salt of organic acid in the undercoat layer is 0.1% by mass or more and 5% by mass or less relative to the total mass of the undercoat layer.

7. The electrophotographic photosensitive member according to claim 1, wherein the undercoat layer does not contain metal oxide particles.

8. The electrophotographic photosensitive member according to claim 1, wherein in (i) the composition further contains a cross-linking agent and a resin having a polymerizable functional group.

9. The electrophotographic photosensitive member according to claim 1, wherein in (ii) the electron transporting compound is a pigment.

10. A process cartridge detachably attached to an electrophotographic apparatus, wherein the process cartridge integrally supports:

the electrophotographic photosensitive member according to claim 1, and at least one device selected from the group consisting of a charging device, a developing device, a transferring device, and a cleaning device.

11. An electrophotographic apparatus comprising:

the electrophotographic photosensitive member according to claim 1;

a charging device;

an exposure device;

a developing device; and a transferring device.

12. A method of producing an electrophotographic photosensitive member which comprises:

a support;

an undercoat layer formed on the support; and a photosensitive layer formed on the undercoat layer;

the method comprising the steps of:

preparing an undercoat layer coating liquid comprising a metal salt of organic acid having at least one metal element selected from the group consisting of Fe, Co, Ni, Cu, and Zn, and (i) the undercoat layer is further obtained by curing an electron transporting compound having a polymerizable functional group, or a composition containing an electron transporting compound having a polymerizable functional group, or ii.) the undercoat layer further comprises an electron transport compound;

forming a coat of the undercoat layer coating liquid; and drying the coat to form the undercoat layer;

wherein the undercoat layer is an electron transporting layer.

13. The method according to claim 12, wherein the undercoat layer coating liquid does not contain metal oxide particles.

14. The electrophotographic photosensitive member according to claim 1, wherein the undercoat layer further comprises a resin selected from butyral resins, alkyd resins, polyamide resins, polyolefin resins, polyvinyl acetal resins, and polyester resins.

15. The electrophotographic photosensitive member according to claim 1, wherein the content of the metal salt of organic acid in the undercoat layer is 0.14% by mass or more and 1.08% by mass or less relative to the total mass of the undercoat layer.

* * * * *